US007618116B2

(12) United States Patent
Hamasaki et al.

(10) Patent No.: US 7,618,116 B2
(45) Date of Patent: Nov. 17, 2009

(54) PRINTING APPARATUS AND METHOD FOR ALTERNATELY PERFORMING PRELIMINARY DISCHARGE CONTROL OF NOZZLES

(75) Inventors: Yuji Hamasaki, Kawasaki (JP); Norihiro Kawatoko, Yokohama (JP); Atsushi Sakamoto, Kawasaki (JP); Takuji Katsu, Kawasaki (JP); Toru Nakayama, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 392 days.

(21) Appl. No.: 11/610,138

(22) Filed: Dec. 13, 2006

(65) Prior Publication Data

US 2007/0139454 A1 Jun. 21, 2007

(30) Foreign Application Priority Data

Dec. 14, 2005 (JP) ..... 2005-360839

(51) Int. Cl.
*B41J 2/165* (2006.01)
*B41J 2/15* (2006.01)

(52) U.S. Cl. ..... 347/35; 347/23; 347/40

(58) Field of Classification Search ..... 347/35
See application file for complete search history.

(56) References Cited

U.S. PATENT DOCUMENTS 4,313,124 A 1/1982 Hara
4,345,262 A 8/1982 Shirato et al.
4,463,359 A 7/1984 Ayata et al.
4,723,129 A 2/1988 Endo et al.
4,740,796 A 4/1988 Endo et al.
5,280,310 A 1/1994 Otsuka et al.
5,774,145 A 6/1998 Morita et al.
5,805,182 A * 9/1998 Lee ..... 347/35
6,257,691 B1 7/2001 Iwasaki et al.
6,312,096 B1 11/2001 Koitabashi et al.
6,325,492 B1 12/2001 Koitabashi et al.
6,637,865 B1 10/2003 Murakami et al.
6,705,694 B1 3/2004 Barbour et al.
6,846,066 B2 1/2005 Teshikawara et al.
6,877,833 B2 4/2005 Teshigawara et al.
6,899,413 B2 5/2005 Otsuka et al.
6,984,009 B2 1/2006 Nakagawa et al.

(Continued)

FOREIGN PATENT DOCUMENTS

JP 8-183179 7/1996

(Continued)

*Primary Examiner*—Matthew Luu
*Assistant Examiner*—Shelby Fidler
(74) *Attorney, Agent, or Firm*—Fitzpatrick, Cella, Harper & Scinto

(57) ABSTRACT

A printing apparatus uses a printhead, which has a first nozzle array and a second nozzle array, each having a plurality of nozzles with a first nozzle discharging a first amount of ink and a second nozzle away having a plurality of nozzles with a second nozzle discharging a second amount of the ink and including nozzles to be used for printing on a printing medium and nozzles not to be used for printing on the printing medium. The printing apparatus selects, from the first nozzle array and the second nozzle array, nozzles to be driven within a predetermined period. The printing apparatus controls preliminary discharge control to drive the nozzles to be used for printing and the nozzles not to be used for printing by alternatively selecting the first nozzles and the second nozzles.

8 Claims, 25 Drawing Sheets

U.S. PATENT DOCUMENTS

| | | | | |
|---|---|---|---|---|
| 2002/0054179 | A1 | 5/2002 | Shibata et al. | |
| 2002/0167560 | A1 | 11/2002 | Fujimori | |
| 2002/0175961 | A1 | 11/2002 | Iwasaki et al. | |
| 2003/0007024 | A1 | 1/2003 | Fujimori | |
| 2003/0142153 | A1 | 7/2003 | Nakajima et al. | |
| 2004/0021717 | A1 | 2/2004 | Nakajima et al. | |
| 2005/0122373 | A1* | 6/2005 | Katsu et al. | 347/22 |
| 2005/0275681 | A1* | 12/2005 | Nakagawa et al. | 347/35 |
| 2006/0050107 | A1 | 3/2006 | Yamanaka et al. | |
| 2006/0187247 | A1 | 8/2006 | Takahashi et al. | |
| 2007/0139510 | A1 | 6/2007 | Hamasaki et al. | |

FOREIGN PATENT DOCUMENTS

| | | |
|---|---|---|
| JP | 8-295033 | 11/1996 |
| JP | 2000-071433 | 3/2000 |
| JP | 2001-129997 | 5/2001 |

* cited by examiner

FIG. 11

| BK_DATA (even) | CORRESPONDING NOZZLES |
|---|---|
| NZL_D [ 9 : 0] BE0 | {288, 256, 224, 192, 160, 128, 96, 64, 32, 0} |
| NZL_D [ 19 : 10] BE1 | {290, 258, 226, 194, 162, 130, 98, 66, 34, 2} |
| NZL_D [ 29 : 20] BE2 | {292, 260, 228, 196, 164, 132, 100, 68, 36, 4} |
| NZL_D [ 39 : 30] BE3 | {294, 262, 230, 198, 166, 134, 102, 70, 38, 6} |
| NZL_D [ 49 : 40] BE4 | {296, 264, 232, 200, 168, 136, 104, 72, 40, 8} |
| NZL_D [ 59 : 50] BE5 | {298, 266, 234, 202, 170, 138, 106, 74, 42, 10} |
| NZL_D [ 69 : 60] BE6 | {300, 268, 236, 204, 172, 140, 108, 76, 44, 12} |
| NZL_D [ 79 : 70] BE7 | {302, 270, 238, 206, 174, 142, 110, 78, 46, 14} |
| NZL_D [ 89 : 80] BE8 | {304, 272, 240, 208, 176, 144, 112, 80, 48, 16} |
| NZL_D [ 99 : 90] BE9 | {306, 274, 242, 210, 178, 146, 114, 82, 50, 18} |
| NZL_D [109 : 100] BE10 | {308, 276, 244, 212, 180, 148, 116, 84, 52, 20} |
| NZL_D [119 : 110] BE11 | {310, 278, 246, 214, 182, 150, 118, 86, 54, 22} |
| NZL_D [129 : 120] BE12 | {312, 280, 248, 216, 184, 152, 120, 88, 56, 24} |
| NZL_D [139 : 130] BE13 | {314, 282, 250, 218, 186, 154, 122, 90, 58, 26} |
| NZL_D [149 : 140] BE14 | {316, 284, 252, 220, 188, 156, 124, 92, 60, 28} |
| NZL_D [159 : 150] BE15 | {318, 286, 254, 222, 190, 158, 126, 94, 62, 30} |

| COLOR_DATA (even) | CORRESPONDING NOZZLES |
|---|---|
| NZL_D [ 3 : 0] BE0 | { 96, 64, 32, 0} |
| NZL_D [ 13 : 10] BE1 | { 98, 66, 34, 2} |
| NZL_D [ 23 : 20] BE2 | {100, 68, 36, 4} |
| NZL_D [ 33 : 30] BE3 | {102, 70, 38, 6} |
| NZL_D [ 43 : 40] BE4 | {104, 72, 40, 8} |
| NZL_D [ 53 : 50] BE5 | {106, 74, 42, 10} |
| NZL_D [ 63 : 60] BE6 | {108, 76, 44, 12} |
| NZL_D [ 73 : 70] BE7 | {110, 78, 46, 14} |
| NZL_D [ 83 : 80] BE8 | {112, 80, 48, 16} |
| NZL_D [ 93 : 90] BE9 | {114, 82, 50, 18} |
| NZL_D [103 : 100] BE10 | {116, 84, 52, 20} |
| NZL_D [113 : 110] BE11 | {118, 86, 54, 22} |
| NZL_D [123 : 120] BE12 | {120, 88, 56, 24} |
| NZL_D [133 : 130] BE13 | {122, 90, 58, 26} |
| NZL_D [143 : 140] BE14 | {124, 92, 60, 28} |
| NZL_D [153 : 150] BE15 | {126, 94, 62, 30} |

FIG. 16

| H_ENB1 | H_ENB2 | BLE | BE4 (L / S) | Nozzle | | BE4 (L / S) | BLE | H_ENB1 | H_ENB2 |
|---|---|---|---|---|---|---|---|---|---|
| × | L | 14 | 0 | DHE0A | DHE0B | 1 | 14 | × | L |
| × | L | 14 | 1 | DHE1B | DHE1A | 0 | 14 | × | L |
| × | L | 15 | 0 | DHE2A | DHE2B | 1 | 15 | × | L |
| × | L | 15 | 1 | DHE3B | DHE3A | 0 | 15 | × | L |
| L | × | 0 | 0 | 0A | 0B | 1 | 0 | L | × |
| L | × | 0 | 1 | 1B | 1A | 0 | 0 | L | × |
| ⋮ | ⋮ | ⋮ | ⋮ | ⋮ | ⋮ | ⋮ | ⋮ | ⋮ | ⋮ |
| × | L | 15 | 0 | 126A | 126B | 1 | 15 | × | L |
| × | L | 15 | 1 | 127B | 127A | 0 | 15 | × | L |
| L | × | 0 | 0 | DH4A | DH4B | 1 | 0 | L | × |
| L | × | 0 | 1 | DH5B | DH5A | 0 | 0 | L | × |
| L | × | 1 | 0 | DH6A | DH6B | 1 | 1 | L | × |
| L | × | 1 | 1 | DH7B | DH7A | 0 | 1 | L | × |

FIG. 18

| NAME | NUMBER OF SHOTS OF PRELIMINARY DISCHARGE OF BLACK | NUMBER OF SHOTS OF PRELIMINARY DISCHARGE OF COLOR LARGE NOZZLES | NUMBER OF SHOTS OF PRELIMINARY DISCHARGE OF COLOR SMALL NOZZLES | DRIVING FREQUENCY | TIMING |
|---|---|---|---|---|---|
| PRELIMINARY DISCHARGE A | 500 | 1000 | 1000 | Bk : 5KHz<br>Col : 10KHz | CAP OPEN |
| PRELIMINARY DISCHARGE G | 0 | 5000 | 5000 | | AFTER SUCTION |
| PRELIMINARY DISCHARGE J | 200 | (500) | 0 | | AFTER SUCTION |
| | ⋮ | ⋮ | ⋮ | ⋮ | ⋮ |
| | ⋮ | ⋮ | ⋮ | ⋮ | ⋮ |
| | ⋮ | ⋮ | ⋮ | ⋮ | ⋮ |
| PRELIMINARY DISCHARGE N | 0 | 0 | 2 | Col : 10KHz | PRINT |
| | ⋮ | ⋮ | ⋮ | ⋮ | ⋮ |
| | ⋮ | ⋮ | ⋮ | ⋮ | ⋮ |

FIG. 19A

| bit | function | | | W/R | at RESET |
|---|---|---|---|---|---|
| 0 | SET WHETHER TO EXECUTE TOGGLE PRELIMINARY DISCHARGE OF BK LARGE MAIN NOZZLES AND SMALL MAIN NOZZLES | 0 : NO TOGGLE | 1 : TOGGLE | W/R | 0 |
| 1 | SET WHETHER TO EXECUTE TOGGLE PRELIMINARY DISCHARGE OF COLOR LARGE MAIN NOZZLES AND SMALL MAIN NOZZLES | 0 : NO TOGGLE | 1 : TOGGLE | W/R | 0 |

FIG. 19B

| bit | function | | | W/R | at RESET |
|---|---|---|---|---|---|
| 0 | SET WHETHER TO EXECUTE TOGGLE PRELIMINARY DISCHARGE OF BK MAIN NOZZLES AND DUMMY NOZZLES | 0 : NO TOGGLE | 1 : TOGGLE | W/R | 0 |
| 1 | SET WHETHER TO EXECUTE TOGGLE PRELIMINARY DISCHARGE OF COLOR MAIN NOZZLES AND DUMMY NOZZLES | 0 : NO TOGGLE | 1 : TOGGLE | W/R | 0 |

PRINTING APPARATUS AND METHOD FOR ALTERNATELY PERFORMING PRELIMINARY DISCHARGE CONTROL OF NOZZLES

BACKGROUND OF THE INVENTION

1. Field of the Invention

The present invention relates to a printing apparatus. A printing apparatus comprises a printhead in which first main nozzles having a first diameter and second main nozzles having a second diameter smaller than the first diameter are alternately arranged in the longitudinal direction on both sides of a common liquid chamber to supply a liquid. This printhead further comprises a plurality of liquid chambers having openings to the first and second main nozzles and communicating with the common liquid chamber. The present invention relates to a printing apparatus which drives and controls a printhead that prints on a printing medium by discharging liquids from first and second main nozzles, a printing apparatus control method, a printhead control circuit, and a printhead driving method.

2. Description of the Related Art

Along with the recent development of personal computers, the printer technology is also remarkably progressing. A printing apparatus is configured to print an image on a printing paper sheet on the basis of image information.

A printing scheme of a printing apparatus that has recently received a great deal of attention is an inkjet printing scheme. An inkjet printing apparatus discharges ink from a printhead to a printing paper sheet. This scheme allows high-speed printing of high-resolution images and is superior to other printing schemes in various points including the running cost and quietness.

The inkjet printing scheme is known to use an electrothermal transducer that generates thermal energy serving as ink droplet discharge energy. In this method, minute nozzles arranged on an inkjet printhead discharge minute ink droplets to print on a printing medium such as a paper sheet.

An inkjet printhead using electrothermal transducers includes a driving system to form ink droplets and a supply system to supply ink to the driving system. The electrothermal transducers are generally provided in a compression chamber. An electrical pulse serving as print data is applied to the electrothermal transducers to give thermal energy to the ink. An abrupt phase change of the ink, i.e., the pressure of bubbles generated upon vaporization at this time is used to discharge the ink.

The structure of a general inkjet printhead will be described here with reference to FIG. 2.

FIG. 2 is a perspective view showing the outer appearance of a general inkjet printhead.

Referring to FIG. 2, the inkjet printhead has nozzle arrays to discharge a plurality of color inks. A black (Bk) nozzle array 1 discharges black ink. A cyan (C) nozzle array 2 discharges cyan ink. A yellow (Y) nozzle array 3 discharges yellow ink. A magenta (M) nozzle array 4 discharges magenta ink.

The detailed structure of each nozzle array will be explained next with reference to FIG. 3.

FIG. 3 is a view showing the structure of nozzle arrays of an inkjet printhead.

As shown in FIG. 3, the mainstream of an inkjet printhead is a staggered nozzle arrangement. In the illustrated example, main nozzles for printing include 320 black (Bk) nozzles and 128 color (COLOR) nozzles (for each color) (FIG. 3 shows cyan, magenta, or yellow nozzles).

Each color nozzle array includes two arrays: an EVEN nozzle array of even-numbered nozzles on the left side and an ODD nozzle array of odd-numbered nozzles on the right side.

Each of the EVEN nozzle array and ODD nozzle array includes 160 nozzles for black and 64 nozzles for each color.

The positional relationship of nozzles will be described. A number of nozzles are arrayed at a predetermined pitch py in the y direction (sub-scanning direction) to form a nozzle array. Two nozzle arrays for the same color are arranged while being spaced apart in the x direction (main scanning direction) by a distance px corresponding to a predetermined number of pixels. The nozzles of the two arrays shift from each other by (py/2) in the y direction.

The main scanning direction is a direction to scan the inkjet printhead. The sub-scanning direction is perpendicular to the main scanning direction.

This structure ensures printing at a resolution (twice the resolution per array) by only adjusting the discharge timings of the two nozzle arrays.

In light of recent improvement of image quality, the size of ink droplets to be discharged is decreasing more and more to obtain high tonality. The color (Color) nozzles on the right side of FIG. 3 include nozzles (large nozzles) that discharge ink droplets in a conventional discharge amount and nozzles (small nozzles) that discharge ink droplets in almost ½ amount. FIG. 3 shows a structure including 128 large nozzles (●) of an ink discharge amount of 5 pl (one color) and 128 small nozzles (○) of an ink discharge amount of 2 pl (one color).

The color (Color) nozzles will be described next.

The color (Color) nozzles shown in FIG. 3 have a two-array structure, as described above. Each color nozzle array includes an EVEN nozzle array of even-numbered nozzles on the left side and an ODD nozzle array of odd-numbered nozzles on the right side. The large nozzles (●) include 64 nozzles in the EVEN nozzle array of even-numbered nozzles and 64 nozzles in the ODD nozzle array of odd-numbered nozzles: a total of 128 nozzles. As for the positional relationship, the nozzles of each of the EVEN and ODD nozzle arrays are arranged at the predetermined pitch py in the y direction. The EVEN and ODD nozzles shift by (py/2). The EVEN and ODD nozzle arrays are arranged while being spaced apart in the x direction by the distance px corresponding to a predetermined number of pixels.

The small nozzles (○) also include 64 nozzles in the EVEN nozzle array of even-numbered nozzles and 64 nozzles in the ODD nozzle array of odd-numbered nozzles: a total of 128 nozzles. The positional relationship is the same as that of the large nozzles except that the positions of the EVEN and ODD nozzle arrays are reverse of those of the large nozzles. That is, the ODD array is arranged on the left side (EVEN array of large nozzles), and the EVEN array is arranged on the right side (ODD array of large nozzles).

The EVEN and ODD nozzles shift by (py/2). The EVEN and ODD nozzle arrays are arranged while being spaced apart in the x direction by the distance px corresponding to a predetermined number of pixels.

The small nozzles (○) and large nozzles (●) shift by (py/2) in each array. That is, each array includes large nozzles arranged at the pitch py and small nozzles arranged at the pitch py, which shift from each other by (py/2). This structure enables to add small nozzles to large nozzles at the same pitch without prolonging the nozzle array.

The schematic structure of a nozzle array will be described next with reference to FIGS. 4 and 5.

FIG. 4 is a view showing the schematic structure of a nozzle array of an inkjet printhead. FIG. 5 is a sectional view of the nozzle array taken along a line X in FIG. 4.

Especially FIG. 4 shows the schematic structure of a nozzle array of an inkjet printhead that discharges a predetermined color ink. Referring to FIG. 4, the inkjet printhead includes a plurality of main nozzles 5 to discharge ink, a plurality of ink chambers 6 with openings to the main nozzles 5, and a long common ink chamber 7 to supply the ink to the ink chambers 6.

The inkjet printhead of a color printer for multicolor printing has a plurality of nozzle arrays, and for example, four nozzle arrays shown in FIG. 4 in correspondence with four color inks, i.e., yellow, magenta, cyan, and black inks. In the above-described inkjet printhead, the main nozzles 5 are arranged at a pitch as small as possible to make the apparatus compact.

The inkjet printhead (to be abbreviated as a printhead hereinafter) handles a liquid. Hence, the printhead also includes a suction recovery mechanism to discharge a thick liquid from the printhead by using a cap, and a preliminary discharge (also called pre-discharge and executed independently of a print signal) mechanism to drive driving elements. Alternatively, a cleaning mechanism to clean the nozzle surface is applied to the inkjet printer.

The inkjet printer has operation sequences "cleaning", "head refreshing", and "wiping" to keep the main nozzle 5 of the printhead clean, as described above.

In the two former sequences, a negative pressure is applied to the cap that covers the main nozzles 5 to suck the ink in the common ink chamber 7, thereby eliminating clogging in the main nozzles 5. After that, preliminary discharge is performed. With wiping, thick ink sticking to the nozzle surface is removed.

Time preliminary discharge is executed even during printing at a predetermined time interval to prevent the ink in the main nozzles 5 unused for printing from thickening by time change and causing discharge errors in the next discharge sequence.

Independently of whether a plurality of color nozzle arrays are provided integrally or separately, liquids of different colors or different characteristics may mix between the printheads of respective colors. Various means for solving this problem are known.

Japanese Patent Laid-Open No. 8-295033 discloses a technique of providing dummy nozzles between adjacent printheads to prevent color mixing between them. More specifically, inks from adjacent printheads are guided to the dummy nozzles. The dummy nozzles discharge the mixed ink, thereby removing the mixed ink. The main nozzles discharge ink to print on a printing medium. The dummy nozzles do not discharge ink to print on a printing medium.

In Japanese Patent Laid-Open No. 2001-129997, some of the main nozzles 5 serve as dummy nozzles 8 along the array direction of the main nozzles 5, as shown in FIG. 6. A dummy ink chamber 9 of each dummy nozzle 8 connects to the common ink chamber 7 of the array of main nozzles 5. In the printhead recovery process, the dummy nozzles 8 can also preliminarily discharge ink that is staying in the common ink chamber 7.

Consequently, the dummy nozzles 8 discharge, together with the liquid, bubbles existing at the two ends of the common ink chamber 7 so that the mixed ink can immediately be discharged. This especially promotes liquid flow between the dummy nozzles 8 and the longitudinal ends of the long common ink chamber 7 to which the ink is supplied. Hence, the dummy nozzle 8 can smoothly and reliably discharge, from the printhead, thick ink that tends to stay at the longitudinal ends of the common ink chamber 7.

In printhead suction recovery by "cleaning" or "head refreshing" as described above, one cap sucks all nozzle arrays (black, cyan, magenta, and yellow) simultaneously. Alternatively, one cap sucks the black nozzle array or the color nozzle arrays (cyan, magenta, and yellow) simultaneously. For this reason, all inks mix in the cap.

The mixed ink in the cap may stick to the nozzle surface of the printhead and may be sucked by the negative pressure in the ink tank after the suction operation stops.

If printing is done in this state, the nozzles discharge inks of undesired colors, resulting in a large degradation in the printed image quality. To prevent this, the nozzles preliminarily discharge the mixed ink sucked in the printhead after suction recovery.

The above-described common ink chamber 7 shown in FIG. 6 is long and therefore readily stores ink at the longitudinal ends. The main nozzles 5 to be used for printing execute preliminary discharge. Then, the dummy nozzles 8 execute preliminary discharge after a predetermined time.

This allows to discharge, from the printhead, the thick ink that is staying at the longitudinal ends. Even in time preliminary discharge executed during printing, the main nozzles 5 used for printing and the dummy nozzles 8 execute preliminary discharge.

The preliminary discharge of the main nozzles 5 and dummy nozzles 8 will be described with reference to FIGS. 7A and 7B.

FIGS. 7A and 7B are views schematically showing preliminary discharge.

FIG. 7A particularly shows preliminary discharge from the main nozzles 5, and FIG. 7B shows preliminary discharge from the dummy nozzles 8.

When the main nozzles 5 execute preliminary discharge, as shown in FIG. 7A, ink is smoothly discharged from the common ink chamber 7 toward the main nozzle outlets but easily stays at the two ends of the common ink chamber 7. These portions will be referred to as stagnation portions 10 hereinafter.

The ink staying at the stagnation portions 10 readily stick. To prevent this, the dummy nozzles 8 execute discharge after discharge from the main nozzles 5, as shown in FIG. 7B, thereby discharging the ink staying at the stagnation portions 10.

Another reason why the main nozzles and dummy nozzles separately execute preliminary discharge will be described below.

A heater board with electrothermal transducers of an inkjet printhead has a limited size from the viewpoint of cost reduction. If it is impossible to arrange, within the size, DATA lines and HeatEnable lines like those for main nozzles, dummy nozzles must share the signal input DATA lines and HeatEnable lines of the block of main nozzles.

If the main nozzles and dummy nozzles of an inkjet printhead with such a wiring structure simultaneously execute preliminary discharge, the number of simultaneously discharging nozzles in a common block becomes more than expected, and the voltage drop increases. This may make preliminary discharge of the main nozzles in the block common to the dummy nozzles insufficient and cause color mixing due to insufficient ink discharge, resulting in an adverse effect on the image quality.

The number of shots of discharge in the preliminary discharge process is generally equal between the main nozzles 5 and the dummy nozzles 8. To execute preliminary discharge of the main nozzles 5 to be used for printing, the dummy nozzles 8 execute preliminary discharge of the same number of shots. That is, the preliminary discharge process of the main nozzles 5 and that of the dummy nozzles 8 are executed separately. This preliminary discharge process therefore requires a double time.

Even in preliminary discharge of small nozzles added by recent improvement of the image quality and resolution, a heater board with electrothermal transducers of an inkjet printhead has a limited size from the viewpoint of cost reduction, as described above. Hence, large nozzles and small nozzles share the signal input DATA lines and HeatEnable lines of each block to arrange DATA lines and HeatEnable lines dedicated to the large nozzles and small nozzles within the size.

It is impossible to make the large nozzles and small nozzles of an inkjet printhead with such a wiring structure simultaneously execute preliminary discharge. The small nozzles also execute the preliminary discharge process, like the conventional large nozzles.

Since the preliminary discharge of the large nozzles and that of the small nozzles are executed separately, the preliminary discharge process requires a longer time.

SUMMARY OF THE INVENTION

The present invention has been made to solve the above-described problem, and has as its object to provide a printing apparatus, a printing apparatus control method, a printhead control circuit, and a printhead driving method, which can shorten the preliminary discharge time of the printhead.

According to the present invention, the foregoing object is attained by providing a printing apparatus for printing by using a printhead which has a first nozzle array and a second nozzle array, each having a plurality of nozzles with a first nozzle from which a first amount of the ink is discharged and a plurality of nozzles with a second nozzle from which a second amount of the ink is discharged and including nozzles to be used for printing on a printing medium and nozzles not to be used for printing on the printing medium, comprising:

driving means for driving the nozzles of the first nozzle array and the second nozzle array;

selection means for selecting, from the first nozzle array and the second nozzle array, nozzles to be driven by the driving means within a predetermined period; and control means including first preliminary discharge control to drive the driving means while alternately selecting, from the first nozzles in the first nozzle array and the second nozzle array, the nozzles to be used for printing on the printing medium and the nozzles not to be used for printing on the printing medium and drive the driving means while alternately selecting, from the second nozzles in the first nozzle array and the second nozzle array, the nozzles to be used for printing on the printing medium and the nozzles not to be used for printing on the printing medium, and second preliminary discharge control to drive the driving means while alternately selecting, from the nozzles to be used for printing on the printing medium in the first nozzle array and the second nozzle array, a group of the first nozzles and a group of the second nozzles and drive the driving means while alternately selecting, from the nozzles not to be used for printing on the printing medium in the first nozzle array and the second nozzle array, the group of the first nozzles and the group of the second nozzles.

In a preferred embodiment, a frequency of a sync signal in the first preliminary discharge control and the second preliminary discharge control is twice a frequency of a sync signal in individual preliminary discharge control for the first nozzle array and the second nozzle array.

In a preferred embodiment, the control means includes a plurality of preliminary discharge modes and executes one of the first preliminary discharge control and the second preliminary discharge control on the basis of the preliminary discharge mode.

In a preferred embodiment, the first preliminary discharge control is executed when the number of shots of preliminary discharge of the nozzles of the first nozzle array is different from the number of shots of preliminary discharge of the nozzles of the second nozzle array.

In a preferred embodiment, in the printhead, the nozzles of the first nozzle array and the nozzles of the second nozzle array form sets of corresponding groups, and a plurality of nozzles of each nozzle array form a group.

In a preferred embodiment, a diameter of the second nozzle is smaller than a diameter of the first nozzle.

According to the present invention, the foregoing object is attained by providing a printing apparatus for printing by using a printhead which has a first nozzle array having a plurality of nozzles with a first nozzle from which a first amount of ink is discharged and a second nozzle array having a plurality of nozzles with a second nozzle from which a second amount of ink is discharged, the first nozzle array and the second nozzle array including nozzles to be used for printing on a printing medium and nozzles not to be used for printing on the printing medium, comprising:

driving means for driving the nozzles of the first nozzle array and the second nozzle array;

selection means for selecting, from the first nozzle array and the second nozzle array, nozzles to be driven by the driving means within a predetermined period; and control means including first preliminary discharge control to drive the driving means while alternately selecting, from the first nozzle array, the nozzles to be used for printing on the printing medium and the nozzles not to be used for printing on the printing medium and drive the driving means while alternately selecting, from the second nozzle array, the nozzles to be used for printing on the printing medium and the nozzles not to be used for printing on the printing medium, and second preliminary discharge control to drive the driving means while alternately selecting, from the first nozzle array and the second nozzle array, the nozzles to be used for printing on the printing medium and drive the driving means while alternately selecting, from the first nozzle array and the second nozzle array, the nozzles not to be used for printing on the printing medium.

According to the present invention, the foregoing object is attained by providing a method of controlling a printing apparatus for printing by using a printhead which has a first nozzle array and a second nozzle array, each having a plurality of nozzles with a first nozzle from which a first amount of ink is discharged and a plurality of nozzles with a second nozzle from which a second amount of ink is discharged and including nozzles to be used for printing on a printing medium and nozzles not to be used for printing on the printing medium, comprising the steps of:

a driving step of driving the nozzles of the first nozzle array and the second nozzle array;

a selection step of selecting, from the first nozzle array and the second nozzle array, nozzles to be driven in the driving step within a predetermined period;

a first preliminary discharge control step of executing the driving step while alternately selecting, from the first nozzles in the first nozzle array and the second nozzle array, the nozzles to be used for printing on the printing medium and the nozzles not to be used for printing on the printing medium and executing the driving step while alternately selecting, from the second nozzles in the first nozzle array and the second nozzle array, the nozzles to be used for printing on the printing medium and the nozzles not to be used for printing on the printing medium; and a second preliminary discharge control step of executing the driving step while alternately selecting, from the nozzles to be used for printing on the printing medium in the first nozzle array and the second nozzle array, a group of the first nozzles and a group of the second nozzles and executing the driving step while alternately selecting, from the nozzles not to be used for printing on the printing medium in the first nozzle array and the second nozzle array, the group of the first nozzles and the group of the second nozzles.

According to the present invention, the foregoing object is attained by providing a method of controlling a printing apparatus for printing by using a printhead which has a first nozzle array having a plurality of nozzles with a first nozzle from which a first amount of ink is discharged and a second nozzle array having a plurality of nozzles with a second nozzle from which a first amount of ink is discharged, the first nozzle array and the second nozzle array including nozzles to be used for printing on a printing medium and nozzles not to be used for printing on the printing medium, comprising:

a driving step of driving the nozzles of the first nozzle array and the second nozzle array;

a selection step of selecting, from the first nozzle array and the second nozzle array, nozzles to be driven in the driving step within a predetermined period;

a first preliminary discharge control step of executing the driving step while alternately selecting, from the first nozzle array, the nozzles to be used for printing on the printing medium and the nozzles not to be used for printing on the printing medium and executing the driving step while alternately selecting, from the second nozzle array, the nozzles to be used for printing on the printing medium and the nozzles not to be used for printing on the printing medium; and a second preliminary discharge control step of executing the driving step while alternately selecting, from the first nozzle array and the second nozzle array, the nozzles to be used for printing on the printing medium and executing the driving step while alternately selecting, from the first nozzle array and the second nozzle array, the nozzles not to be used for printing on the printing medium.

Further features of the present invention will become apparent from the following description of exemplary embodiments with reference to the attached drawings.

BRIEF DESCRIPTION OF THE DRAWINGS

FIG. 11 is a view showing an example of division of nozzle arrays of the printhead according to the embodiment of the present invention;

FIG. 16 is a view showing a connection arrangement example of driving signals and the nozzles of the printhead according to the embodiment of the present invention;

FIG. 18 is a view showing examples of preliminary discharge modes according to the embodiment of the present invention;

FIG. 19A is a view showing a register to set ON/OFF of large/small nozzle toggle preliminary discharge according to the embodiment of the present invention;

FIG. 19B is a view showing a register to set ON/OFF of main/dummy nozzle toggle preliminary discharge according to the embodiment of the present invention;

DESCRIPTION OF THE EMBODIMENT

A preferred embodiment of the present invention will now be described in detail in accordance with the drawings. It should be noted that the relative arrangement of the components, the numerical expressions and numerical values set forth in these embodiments do not limit the scope of the present invention unless it is specifically stated otherwise.

An embodiment of the present invention will be described below in detail with reference to the accompanying drawings.

In this specification, a term "print" not only indicates formation of significant information such as characters and graphics but also broadly includes formation of images, figures, patterns, and the like by supplying a liquid onto a printing medium or processing of the medium, regardless of whether they are significant or insignificant and whether they are so visualized as to be visually perceivable by humans.

Also, a term "printing medium" includes not only a paper sheet used in common printers but also broadly materials such as cloth, a plastic film, and a metal plate capable of accepting ink discharged from a printhead.

A term "ink" should be extensively interpreted similar to the definition of "print" above. That is, "ink" indicates a liquid which can form images, figures, patterns, and the like when given onto printing medium or can process the printing medium.

A large nozzle and a small nozzle are different in the ink amount discharged at a time. That is, a nozzle with a relatively large ink amount is a large nozzle. A nozzle with a relatively small ink amount is a small nozzle. Each of the large and small nozzles is normally formed from a round nozzle. For example, assume that a first nozzle is a large nozzle. A first nozzle diameter as a diameter indicating the representative nozzle diameter of the first nozzles is larger than a second nozzle diameter of a small nozzle serving as a second nozzle. That is, first nozzle diameter>second nozzle diameter. In this embodiment, a nozzle having the first nozzle diameter will be referred to as a large nozzle, and a nozzle having the second nozzle diameter will be referred to as a small nozzle for the descriptive convenience.

A main nozzle discharges ink serving as dots to form an image. That is, a main nozzle discharges the ink to print on a printing medium. On the other hand, a dummy nozzle discharges the ink not to print on a printing medium.

The nozzle shape is not limited to round. A nozzle can have any other shape such as a star or elliptic shape. In this case, a diameter regarded as the representative diameter of a circumscribed circle of the shape is defined as the nozzle diameter. For example, if the nozzle shape is elliptic, the major axis is defined as the nozzle diameter.

Figure 8:
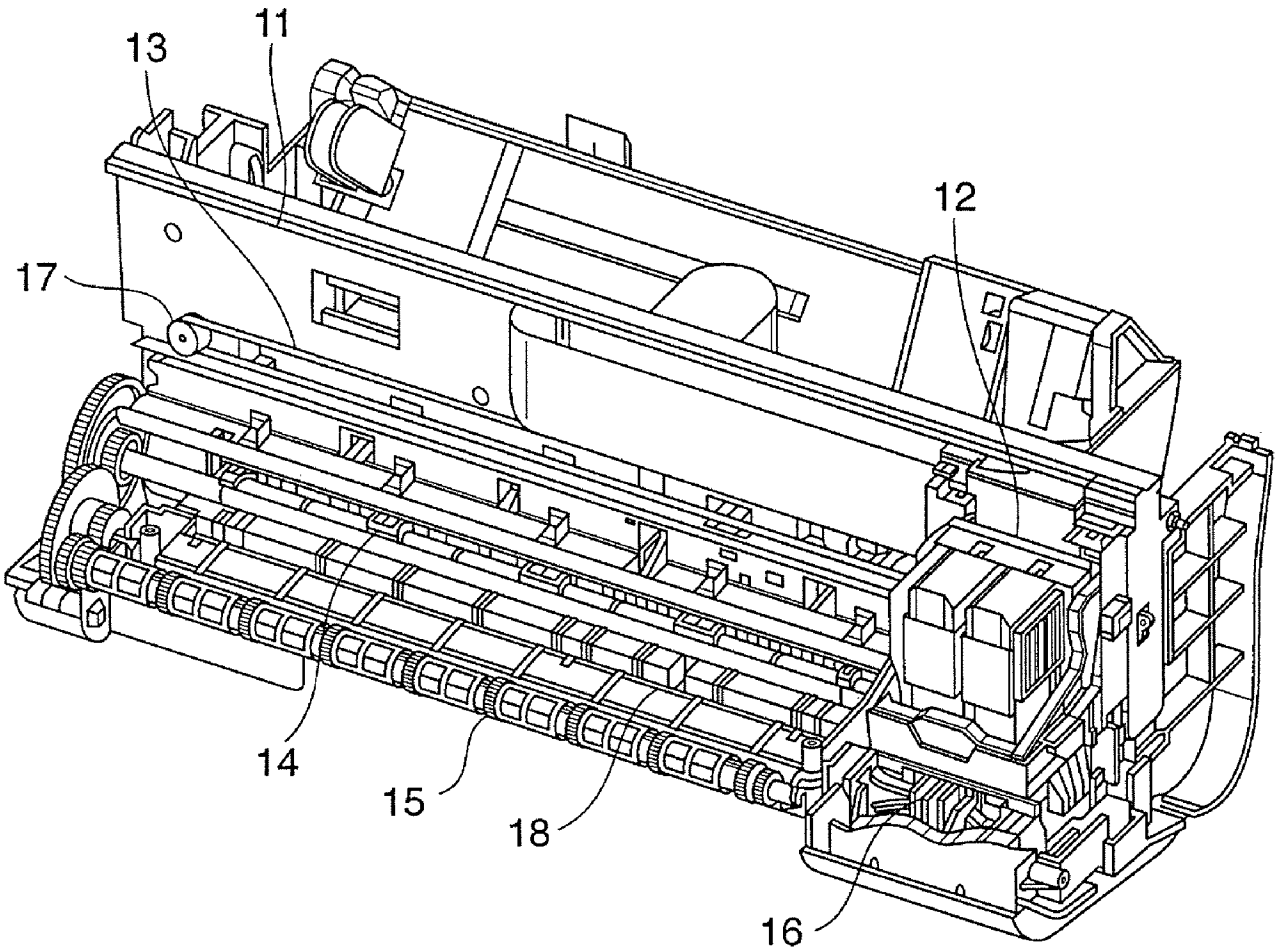
FIG. 8 is a perspective view of an inkjet printer applicable to the embodiment of the present invention.

FIG. 8 is a perspective view of an inkjet printer applicable to the embodiment of the present invention.

The functional components of an inkjet printer 11 are roughly classified into a carriage 12, timing belt 13, conveyance roller 14, discharge roller 15, cleaning unit 16, carriage motor 17, and platen 18. The inkjet printer 11 will simply be referred to as the printer 11 hereinafter.

The timing belt 13 loops over between a pulley attached to the shaft of the carriage motor 17 and a pulley located at a symmetrical position. Part of the timing belt 13 connects to the carriage 12 to transmit the driving force of the carriage motor 17. The discharge roller 15 is set to rotate at a slightly higher speed than the conveyance roller 14 to apply a proper tension to a printing medium on the platen 18.

The back-side structure of the carriage 12 will be described next with reference to FIG. 9.

Figure 9:
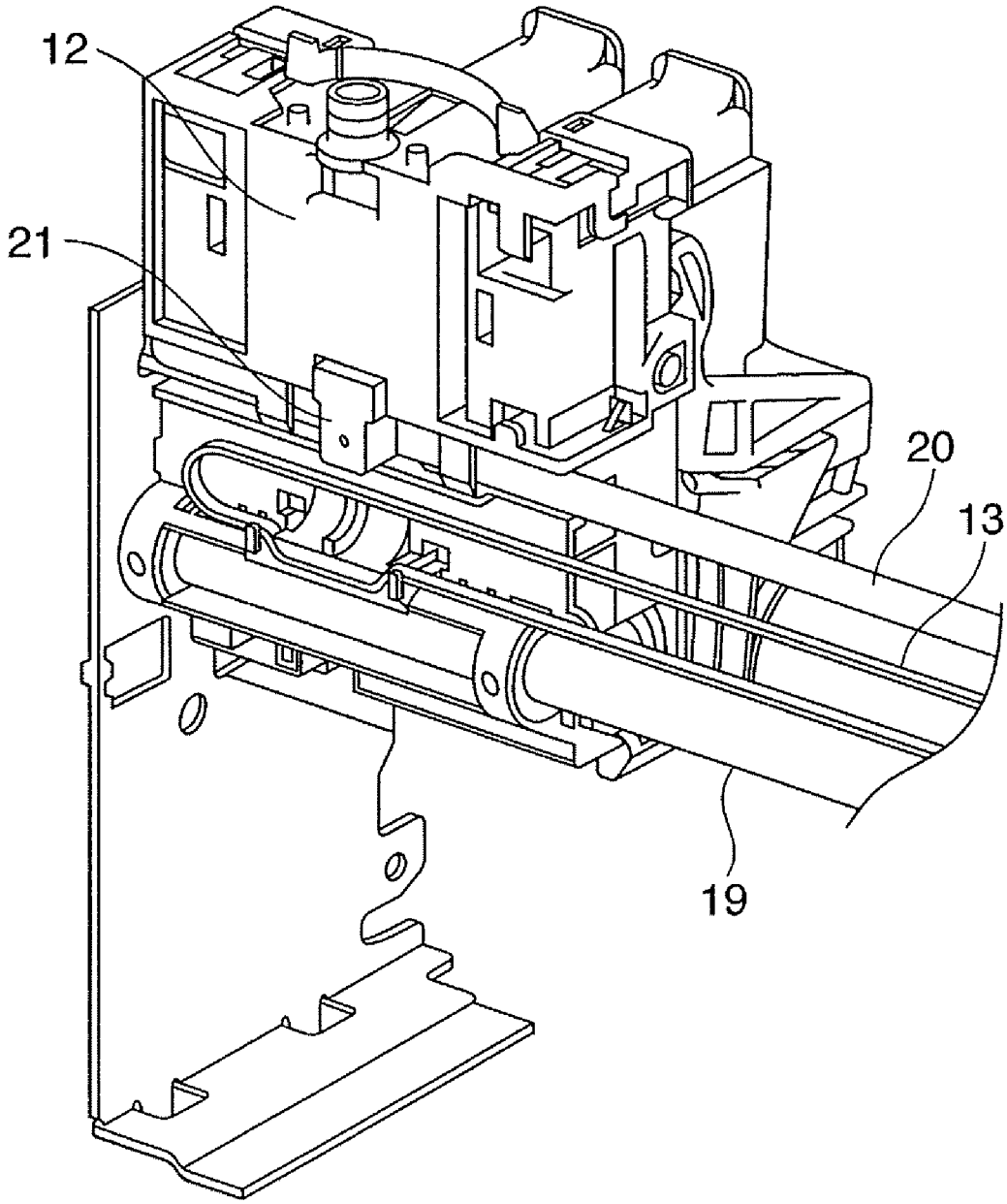
FIG. 9 is a perspective view showing the back-side structure of a carriage according to the embodiment of the present invention.

FIG. 9 is a perspective view showing the back-side structure of the carriage according to the embodiment of the present invention.

The carriage 12 is supported by a shaft 19 so as to move in the horizontal direction. An encoder 21 to read a scaler 20 is arranged on the back side of the carriage 12.

The encoder 21 reads the scaler 20 running across the printer 11 as the carriage 12 moves. The printer 11 constantly monitors the displacement amount of the carriage 12 by the encoder 21 and performs feedback control of the carriage motor 17 on the basis of that information. Timing information for driving the printhead mounted on the carriage 12 is also generated on the basis of the position information of the encoder 21.

A control circuit to control various kinds of operations of the printer 11 will be described next with reference to FIG. 10.

Figure 10:
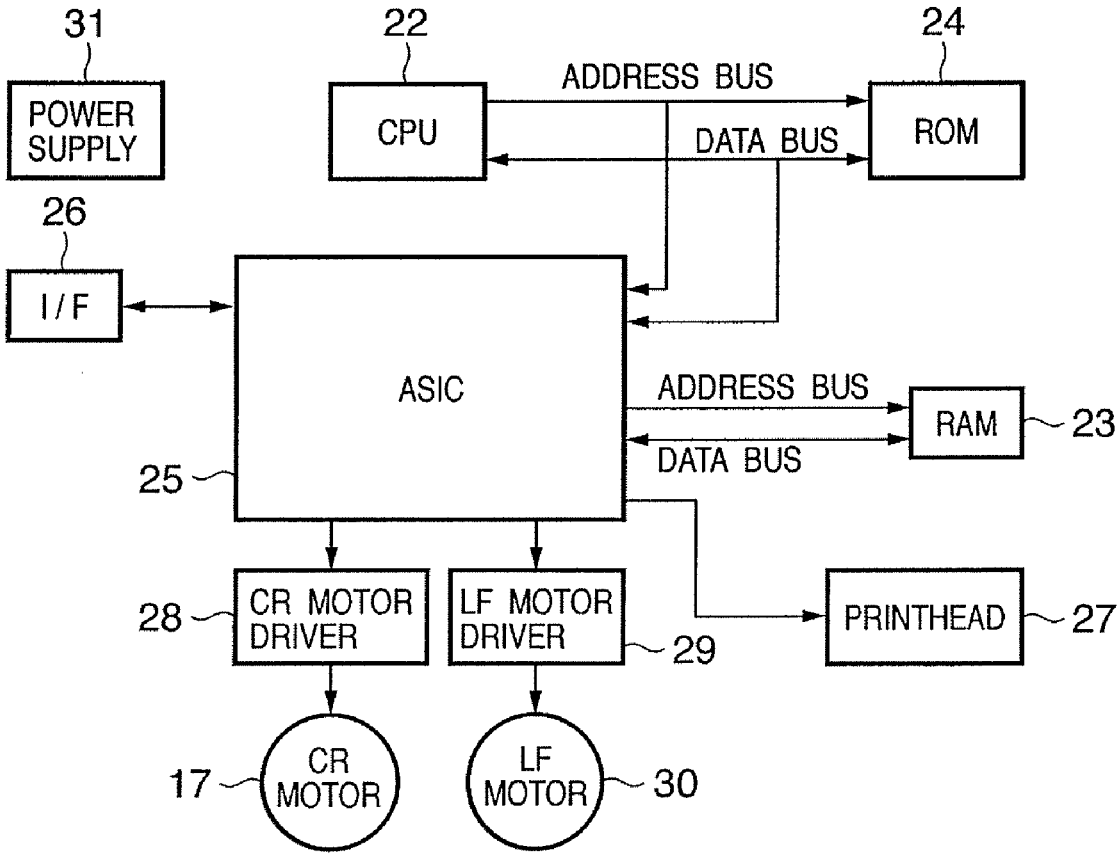
FIG. 10 is a block diagram showing the overall arrangement of the control circuit of the printer according to the embodiment of the present invention.

FIG. 10 is a block diagram showing the overall arrangement of the control circuit of the printer according to the embodiment of the present invention.

The main components of the printer 11 include a CPU 22, RAM 23, ROM 24, ASIC 25, interface (I/F) 26, printhead 27, and power supply 31.

FIG. 10 illustrates the elements as discrete components. Instead, all the elements may be integrated in one LSI package.

The ROM 24 has a program area that stores various kinds of programs to control the printer 11. This program area stores the firmware of the printer 11 and the motor driving table.

The ASIC 25 controls not only motor driving but also image processing, communication with a host computer via the interface (I/F) 26, and ink discharge from the printhead 27.

The RAM 23 serves as a receive buffer to temporarily save data received from the host computer. The RAM 23 also serves as a work area used by the ASIC 25 as a temporarily memory for image processing and a scroll print buffer to save print data. The driving data table to control driving of the motor is bitmapped in the work area.

Motor drivers to drive various motors of the printer 11 include two motors: a CR motor driver 28 for driving the carriage (CA) and an LF motor driver 29 for sheet conveyance (LF). The carriage (CR) motor 17 and paper conveyance (LF) motor 30 are driven by the corresponding motor drivers.

The combination of motor drivers and motors in FIG. 10 is merely an example. The number of motors and the number of motor drivers can change depending on the printer.

The power supply 31 generates, from a commercial power, a logic power for driving semiconductor devices, a power for driving the drivers, and a power for driving the head. The DC/DC converter used in the power supply 31, the CR motor driver 28, and the LF motor driver 29 may be integrated on a one-chip IC.

Figure 3:
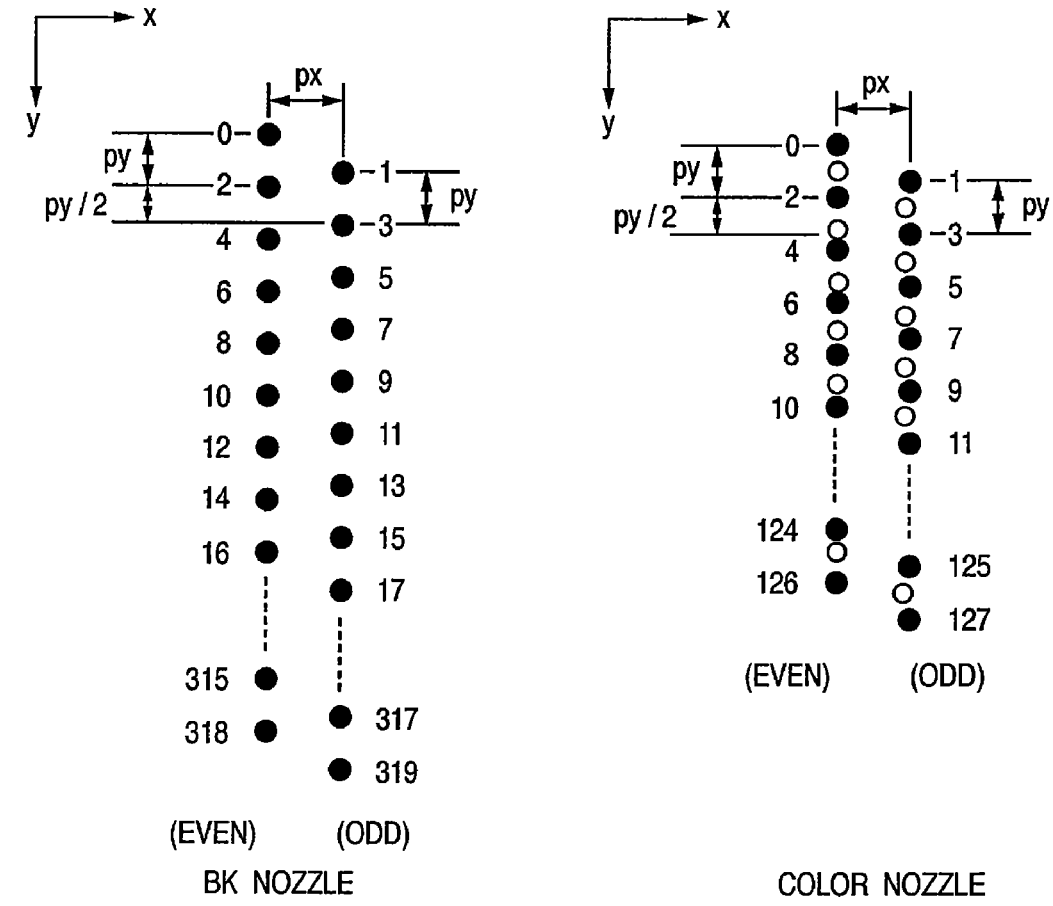
PRIOR ART FIG. 3
FIG. 3 is a view showing the structure of nozzle arrays of an inkjet printhead.
Figure 4:
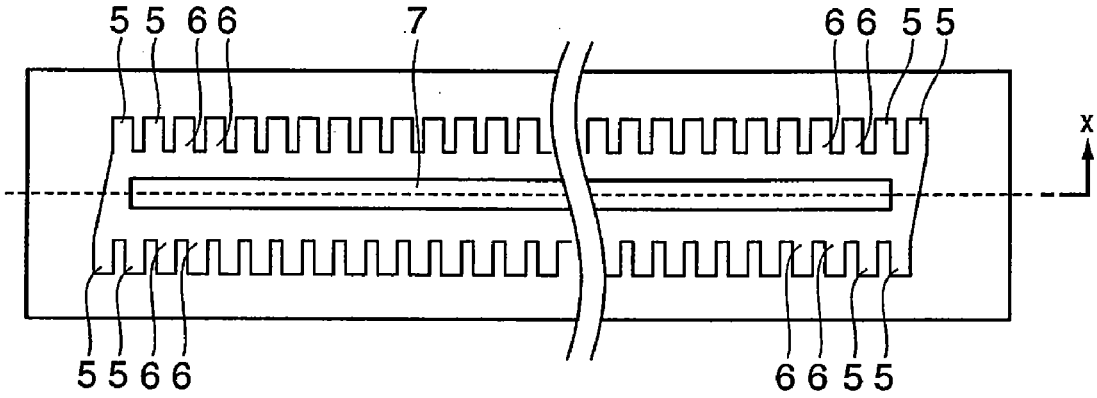
PRIOR ART FIG. 4
FIG. 4 is a view showing the schematic structure of a nozzle array of an inkjet printhead.
Figure 5:
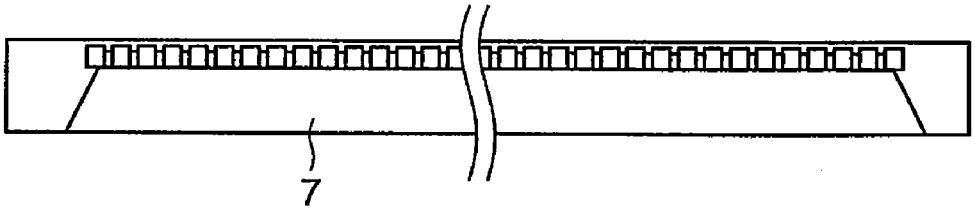
PRIOR ART FIG. 5
FIG. 5 is a sectional view showing the sectional structure of the nozzle array taken along a line X in FIG. 4.
Figure 6:
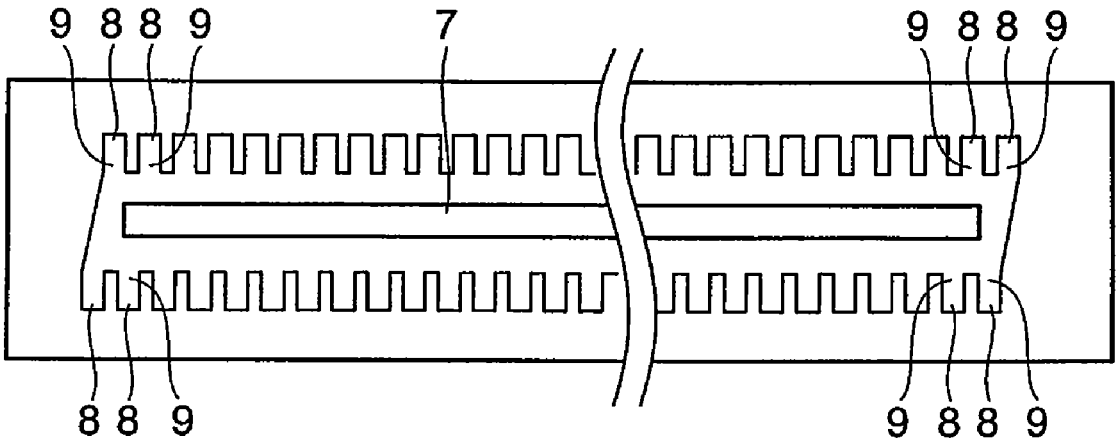
PRIOR ART FIG. 6
FIG. 6 is a view showing the schematic structure of a nozzle array of an inkjet printhead.
Figure 7A:
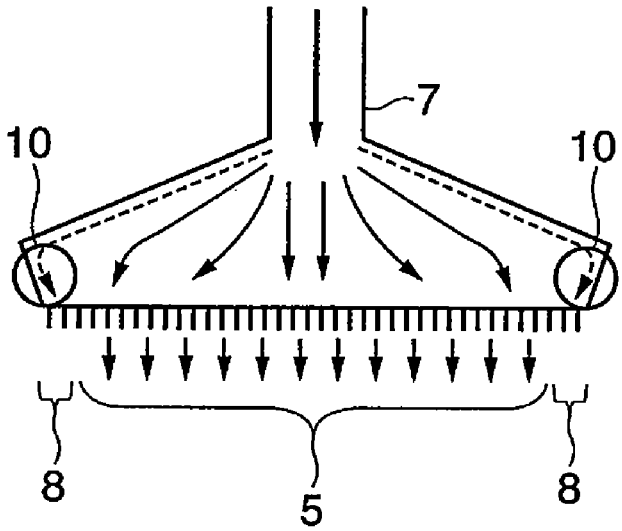
PRIOR ART FIG. 7A
FIGS. 7A and 7B are views schematically showing preliminary discharge.
Figure 7B:
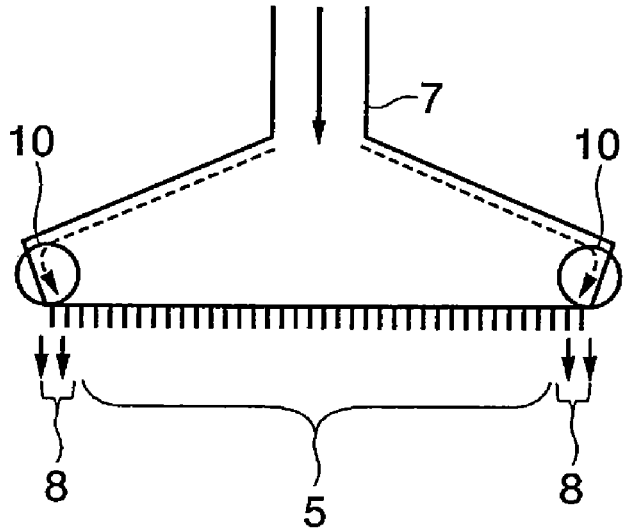
PRIOR ART FIG. 7B

In a method generally used to drive the printhead 27, the plurality of nozzles arrayed in lines in the column direction (y direction) in FIG. 3 are divided into several nozzle groups which are driven at different timings (time-divisional drive (driving)). For example, Japanese Patent Laid-Open No. 2000-071433 describes this method in detail. The time-divisional drive of nozzles allows to increase the ink supply speed and stability and reduce power consumption necessary for discharge.

The internal structure of the printhead 27 will be described with reference to FIG. 25. A heater driving signal is input from a terminal 2501. Voltage applied to a heater is input from a terminal 2506. A clock signal is input from a terminal 2502. Data is input from a terminal 2503. Of the input data, selection data is sent to a selection data transfer circuit 2508, and image data is sent to a data transfer circuit 2511. The selection data from the selection data transfer circuit 2508 is held by a selection data holding circuit 2509 and decoded by a decoder 2510. The selection data holding circuit 2509 outputs a signal 2313A to the decoder 2510 in correspondence with the value of BE4 (L/S) in FIG. 14. An inverting circuit 2504 inverts the signal 2513A into a signal 2513B. One of heaters A and B is driven by these signals 2513A and 2513B.

The nozzle array will be described. In case of cyan nozzle array, m numbers of large nozzle and m numbers of small nozzle are comprised. Accordingly, m numbers of the heaters A are comprised for the large nozzle and m numbers of the heater are comprised for the small nozzle. One of heaters A and B is driven by these signals 2313A and 2313B. A driving circuit 2507 drives the heater A and the heater B.

The image data from the data transfer circuit 2511 is held by a holding circuit 2512 and output to nozzle groups S(1) to S(m). The image data is input from a terminal 2503 in synchronism with a clock signal. A selection data holding circuit 2509 holds the selection data on the basis of a latch signal input from an input terminal 2305. The nozzle groups S include the heaters A for large nozzles and the heaters B for small nozzles.

The heater driving signal is input to the heaters A and B of the groups S(1) to S(m). A selection circuit 2504 selects one of the heaters A and B for each group S.

In the above-described arrangement, the large and small nozzles share the image data signal lines and control lines for nozzle selection.

The host computer generates print data to implement print control of the control circuit and controls output of the print data to the printer 11. For example, a dedicated program such as a printer driver which is installed in the host computer in correspondence with printer 11 implements the print data generation/output control. However, dedicated hardware to implement the processing executed by the dedicated program may implement the print data generation/output control.

The host computer has standard constituent elements mounted on a general-purpose computer such as a personal computer (including various kinds of computers such as a notebook computer and desktop computer). The constituent elements include, e.g., a CPU, RAM, ROM, hard disk, external storage device, network interface, display, keyboard, and mouse.

The host computer can be not only a personal computer but also a digital camera or a portable terminal such as a portable phone or PDA.

An example of division of nozzle arrays for time-divisional drive of the printhead 27 will be described next with reference to FIG. 11.

FIG. 11 is a view showing an example of division of nozzle arrays of the printhead according to the embodiment of the present invention.

FIG. 11 shows, in a table format, the nozzle arrangement of each of 16 divided blocks of the black nozzle array and color nozzle array. As shown in FIG. 11, every 32nd nozzles belong to the same block. On the EVEN side, every 16th nozzles belong to the same block. When each block includes nozzles arranged at a predetermined interval, it is possible to minimize the influence of driving of adjacent nozzles.

A printhead control block to drive the printhead 27 will be described next. The printhead control block is one block of the ASIC 25. This will be described with reference to FIG. 12.

Figure 12:
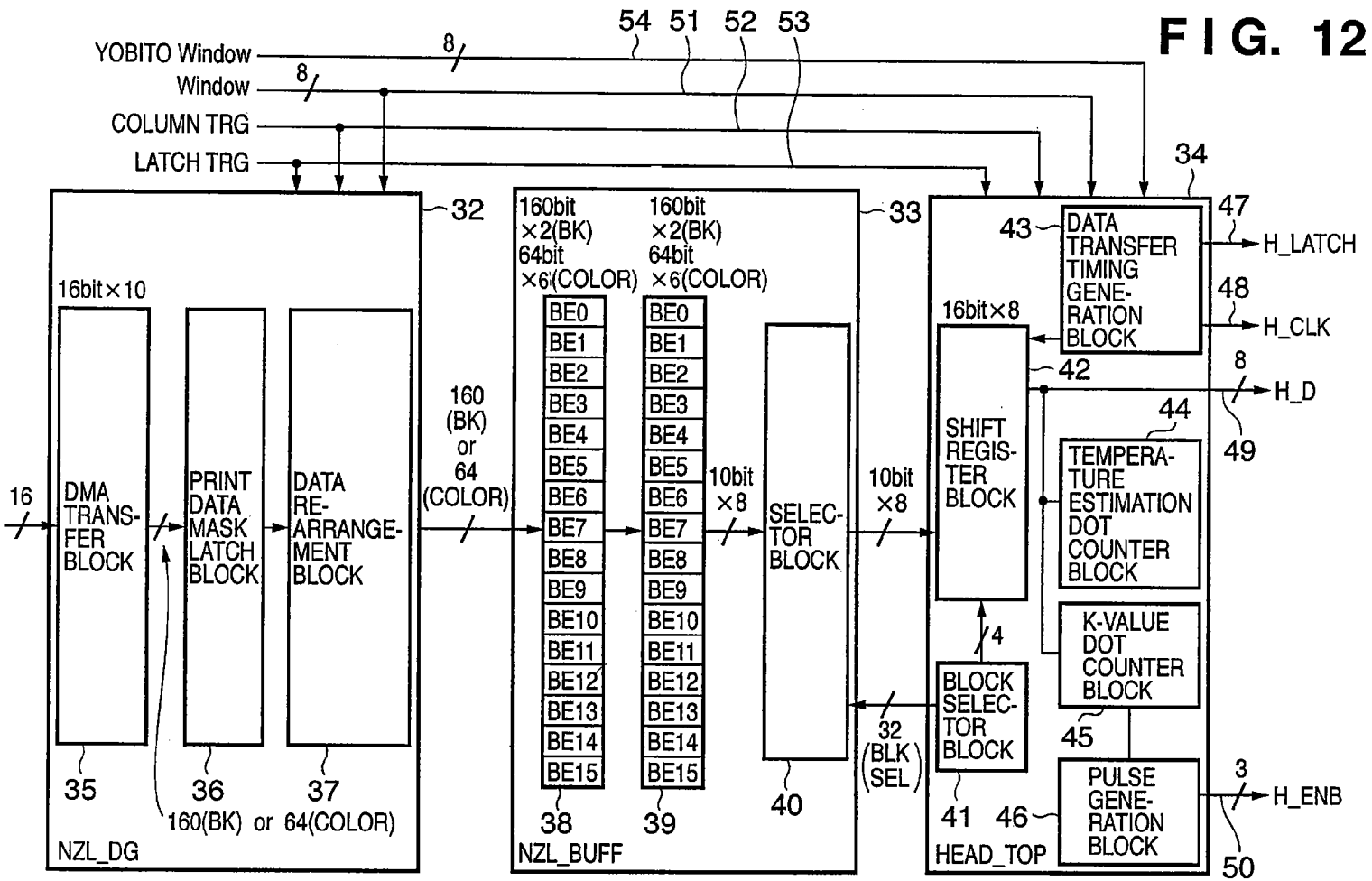
FIG. 12 is a block diagram showing a printhead control block according to the embodiment of the present invention.

FIG. 12 is a block diagram showing the printhead control block according to the embodiment of the present invention.

As is apparent from FIG. 12, the printhead control block includes three blocks: nozzle data generation block (NZL_DG) 32, nozzle data holding block (NZL_BUFF) 33, and printhead control block (HEAD_TOP) 34.

Reference timing signals to drive the printhead control block 34 are a Window 51, Column TRG 52, and Latch TRG 53 which are output from a block to generate a print timing from an encoder signal (not shown).

For the Window 51, a flag is set (Window Open) when the carriage 12 moves in the raster direction (main scanning direction) and arrives at a print designation point. The flag is cleared (Window Close) when printing is complete. The Window 51 is provided for each of the EVEN and ODD nozzle arrays of the black and three color nozzle arrays. That is, the Window 51 contains a total of eight signal bits.

The Column TRG 52 is a trigger signal output at a column interval. The interval of column trigger corresponds to the print resolution in the raster direction.

The Latch TRG 53 is generated at a timing obtained by uniformly dividing the column interval by the number of blocks. When 16 blocks of nozzle arrays are present as in this embodiment, 16 signals Latch TRG 53 are generated in one column time.

A YOBITO Window 54 is a window signal for color setting in preliminary discharge. The YOBITO Window 54 is provided for each of the EVEN and ODD nozzle arrays of the black and three color nozzle arrays. That is, the YOBITO Window 54 contains a total of eight signal bits. The YOBITO Window 54 does not synchronize with the encoder signal output as the carriage 12 moves. The YOBITO Window 54 is a flag signal to set the Window 51 of a nozzle array set for preliminary discharge open and execute preliminary discharge.

The nozzle data generation block (NZL_DG) 32 includes a DMA (Direct Memory Access) transfer block 35, print data mask latch block 36, and data rearrangement block 37.

Figure 2:
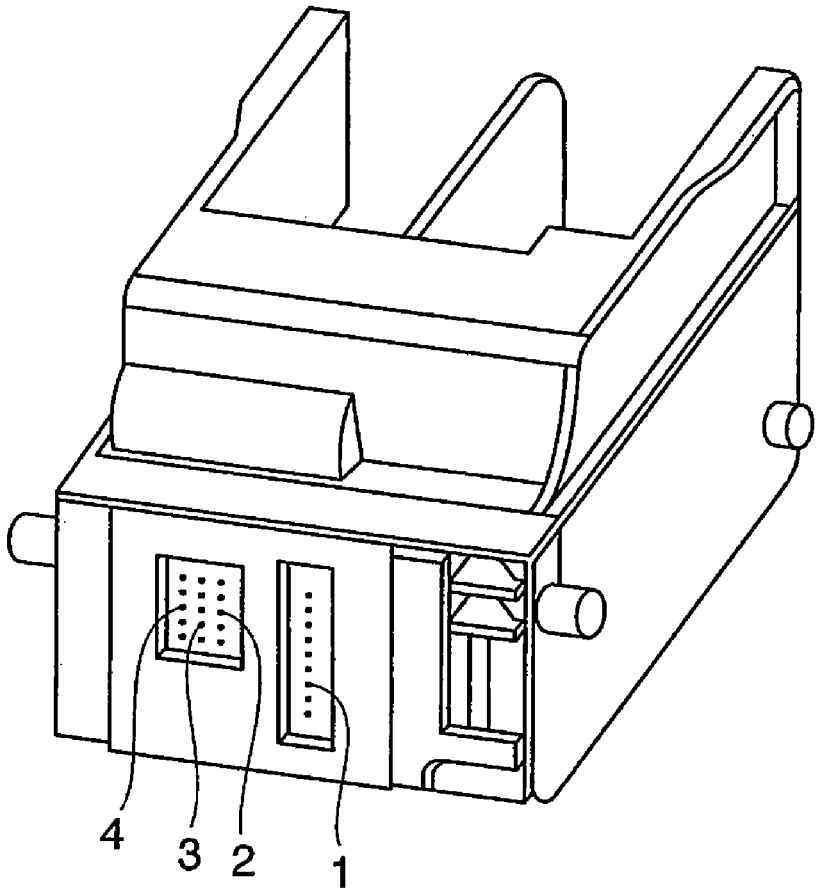
PRIOR ART FIG. 2
FIG. 2 is a perspective view showing the outer appearance of a general inkjet printhead.

The DMA transfer block 35 receives print data rasterized on the RAM 23 by DMA transfer. If all nozzles of the print nozzle example shown in FIG. 2 are to be used for printing, data corresponding to 16 (bit)×10 (number of times of DMA) =160 (bit) is received for the black EVEN nozzle array or ODD nozzle array. For an EVEN nozzle array or ODD nozzle array of one color, data corresponding to 16 (bit)×4 (number of times of DMA)=64 (bit) is received. The number of times of DMA changes depending on the number of nozzles to be used.

The print data mask latch block 36 has a function of latching the print data acquired by DMA transfer and setting, on the basis of register information (not shown), a mask (nozzle mask) on nozzles that are not to be used. A nozzle mask can be set for each nozzle.

The data rearrangement block 37 rearranges print data on the basis of the print nozzle blocks. That is, the data rearrangement block 37 rearranges print data to the nozzle data arrays of the blocks on the basis of nozzle information that forms the blocks shown in FIG. 11.

Main signals to activate the nozzle data generation block (NZL_DG) 32 include a combination of the Window 51 and Column TRG 52. That is, print data arrives at a print designation point by the Window 51. Upon receiving the Column TRG 52, acquisition of print data starts. When the Window 51 closes, acquisition of print data stops.

The nozzle data holding block (NZL_BUFF) 33 is a buffer to hold nozzle data having the block arrangement shown in FIG. 11.

The data array coincides with the nozzle array of each block of the printhead 27 to facilitate data management and, by this, facilitate print driving data generation by the printhead 27.

The buffer of the nozzle data holding block (NZL_BUFF) 33 includes two stages: a first buffer 38 and a second buffer 39. Each buffer holds data of one column of all colors, i.e., all block data of one column.

For black, each buffer has a 160 bit×2 structure corresponding to the EVEN nozzle array and ODD nozzle array. For the three colors, each buffer has a 64 bit×6 structure corresponding to the EVEN nozzle arrays and ODD nozzle arrays.

Data in the buffer has a block arrangement shown in FIG. 11. For black, 10 (bit)×16 (block)=160 (bit). For a color, 4 (bit)×16 (block)=64 (bit).

This buffer has the two-stage structure to transfer each block data in one column to the printhead 27 while preparing the data of the next column. The first buffer 38 is on the write side, and the second buffer 39 is on the read side.

A selector block 40 successively selects a block and outputs nozzle data of the block on the basis of a block selection signal from a block selector block 41 of the printhead control block (HEAD_TOP) 34.

The bus width of nozzle data is 10 (bit)×8 (colors). As shown in FIG. 11, in black data (BK_DATA), nozzle data are assigned to all the 10 bits. Color data (COLOR_DATA) has only 4 bits. Hence, data "0" is set for upper six bits. Both the black nozzle data and color nozzle data have the same bus width to share the circuits of the printhead control block (HEAD_TOP) 34.

The printhead control block (HEAD_TOP) 34 includes the block selector block 41, shift register block 42, and data transfer timing generation block 43. The printhead control block (HEAD_TOP) 34 also includes a temperature estimation dot counter block 44, K-value dot counter block 45, and pulse generation block 46.

The printhead control block (HEAD_TOP) 34 outputs driving signals H_LATCH 47, H_CLK 48, H_D 49, and H_ENB 50 of the printhead 27.

The Window 51 and Latch TRG 53 mainly activate the printhead control block (HEAD_TOP) 34. To make the printhead 27 execute preliminary discharge, the YOBITO Window 54 selects nozzle arrays. At a print designation point, the Window 51 opens, or the preliminary discharge sequence starts. Only when the YOBITO Window 54 opens, the Latch TRG 53 and Column TRG 52 are validated.

The block selector block 41 outputs a block selection signal to the selector block 40 of the nozzle data holding block (NZL_BUFF) 33 in accordance with the block order by the trigger signal Latch TRG 53 for time-divisional drive of the printhead 27. Simultaneously, the block selector block 41 outputs the block selection signal to the shift register block 42.

The shift register block 42 causes a shift register to convert the nozzle data and block selection signal output from the nozzle data holding block (NZL_BUFF) 33 into serial data and outputs the data as the printhead driving data H_D 49. The printhead driving data H_D 49 contains eight signal bits because each of the black and three color nozzle arrays has EVEN and ODD nozzle arrays.

The data transfer timing generation block 43 generates the transfer clock H_CLK 48 to transfer the printhead driving data H_D 49 to the printhead 27 on the basis of the Latch TRG 53. The data transfer timing generation block 43 also generates the latch signal H_LATCH 47 to latch data in the shift register in the printhead 27. The data transfer timing generation block 43 outputs a data shift timing signal to the shift register block 42.

The temperature estimation dot counter block 44 and K-value dot counter block 45 are arithmetic blocks to correct, in accordance with the nozzle discharge frequency, the driving pulse width of the heat enable signal H_ENB 50 generated by the pulse generation block 46.

The temperature estimation dot counter block 44 is used to change the correction table at an interval of several ten ms. The K-value dot counter block 45 corrects the optimum heat pulse width of the next block on the basis of the heat state by the nozzle discharge frequency of the preceding block with reference to the Latch TRG 53 (this correction control will be referred to as K-value control hereinafter).

The heat enable signal H_ENB 50 contains one signal bit for black and two signal bits for a color. The two signal bits are assigned to a color to distribute the energy necessary for discharge by shifting the heat timing.

The drive timing of the printhead 27 will be described next with reference to FIG. 13.

Figure 13:
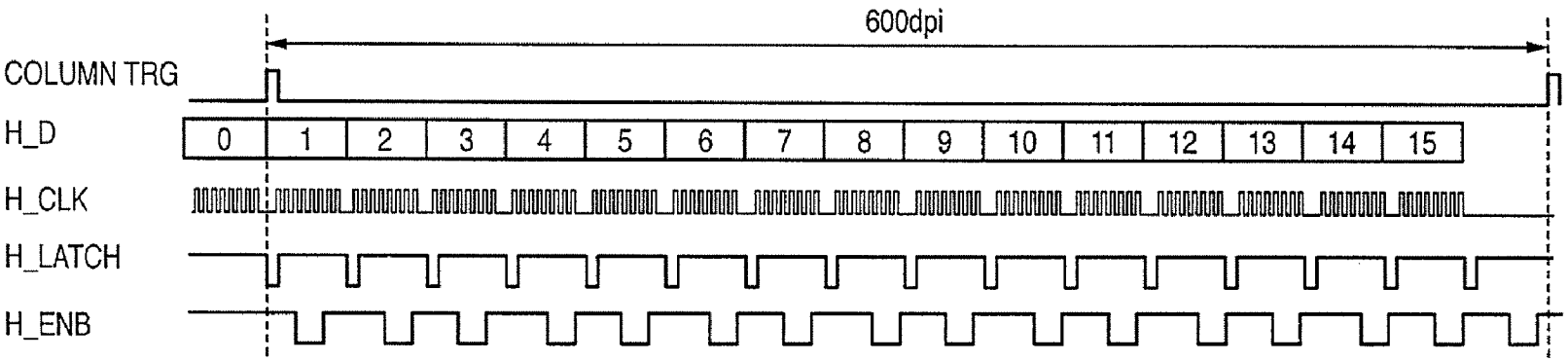
FIG. 13 is a timing chart showing the drive timing of the printhead according to the embodiment of the present invention.

FIG. 13 is a timing chart showing the drive timing of the printhead according to the embodiment of the present invention.

Especially, FIG. 13 shows the printhead drive timing per column in printing at a resolution of 600 dpi.

Referring to FIG. 13, the Column TRG 52 is an internal signal. The H_LATCH 47, H_CLK 48, H_D 49, and H_ENB 50 are printhead driving signals. As shown in FIG. 13, one column includes 16 blocks which are time-divisionally driven.

The printhead driving data H_D 49 is transferred to the shift register in the printhead 27 in accordance with the transfer clock H_CLK 48 and latched at the trailing edge of the H_LATCH 47. The latched printhead driving data causes discharge by the heat pulse of the heat enable signal H_ENB 50 of the next block. In addition, data transfer for the next drive is done.

The relationship between the transfer clock H_CLK 48 and the printhead driving data H_D 49 will be described next with reference to FIG. 14.

Figure 14:
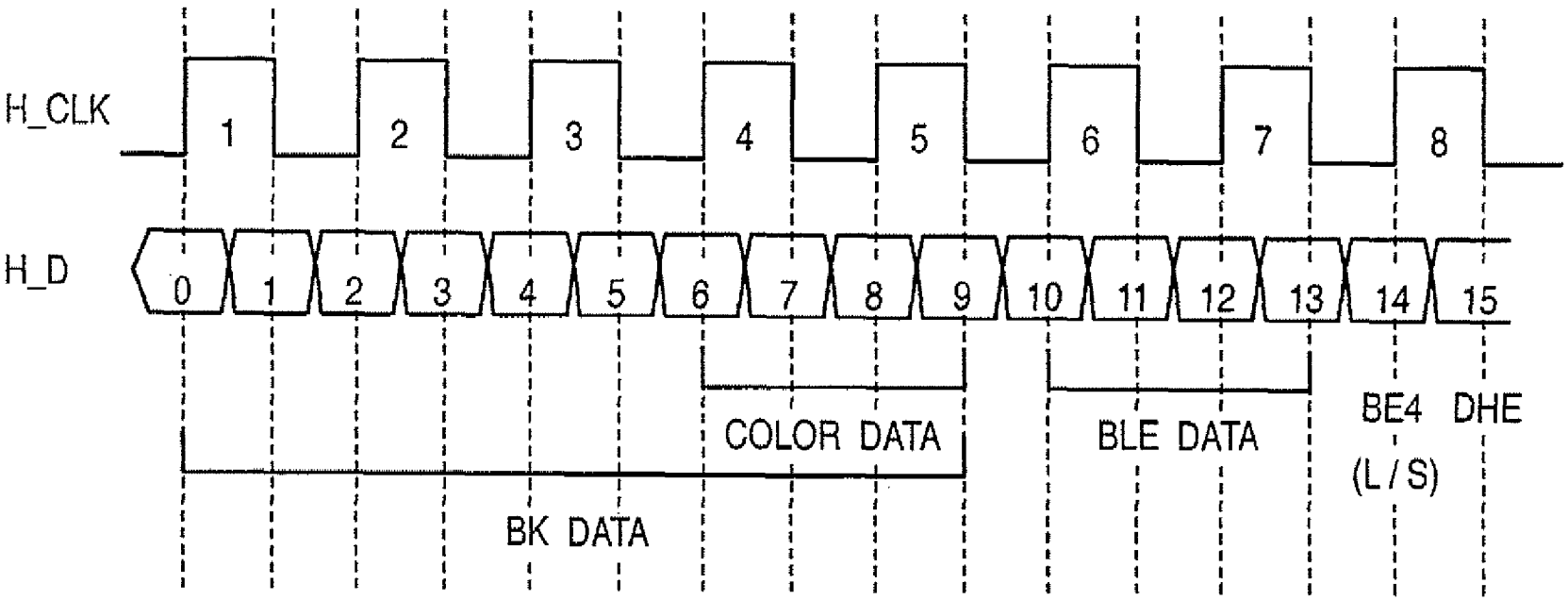
FIG. 14 is a timing chart showing the relationship between a transfer clock and printhead driving data according to the embodiment of the present invention.

FIG. 14 is a timing chart showing the relationship between the transfer clock and the printhead driving data according to the embodiment of the present invention.

The printhead driving data H_D 49 enables data acquisition at both the edges of the transfer clock H_CLK 48. The frequency of the transfer clock H_CLK 48 is about 6 MHz.

The printhead driving data H_D 49 contains nozzle data from bit0 to bit9. The nozzle data contains 10 bits for black and 4 bits from bit6 to bit9 for a color. Four bits from bit10 to bit13 correspond to block selection data BLE. A driving block is selected in the printhead 27 on the basis of the 4-bit block selection data BLE.

In addition, bit14 corresponds to heater switching data BE4 (L/S) to select a large heater (heater A) or small heater (heater B) (to be described later) for the color main nozzle 5. A large nozzle has a large heater. A large nozzle has a small heater.

The large heater causes a nozzle to discharge ink of about 5 pl. The small heater causes a nozzle to discharge ink of about 2 pl. Then, bit15 corresponds to a dummy nozzle selection data DHE to select the dummy nozzle 8. A dummy nozzle to discharge is selected by combining the dummy nozzle selection data DHE and block selection data BLE.

For preliminary discharge of the printhead 27, data corresponding to nozzles for preliminary discharge is set in the first buffer 38 of the nozzle data holding block (NZL_BUFF) 33 and latched to the second buffer 39.

Nozzle arrays to do preliminary discharge are set for the setting register of the YOBITO Window 54. The Column TRG 52 and Latch TRG 53 are generated at an arbitrary timing without using the timing of an encoder signal and input to the printhead control block (HEAD_TOP) 34. The above-described method realizes the preliminary discharge operation.

The arrangement of the printhead most suitable for the present invention will be described next with reference to FIG. 15.

Figure 15:
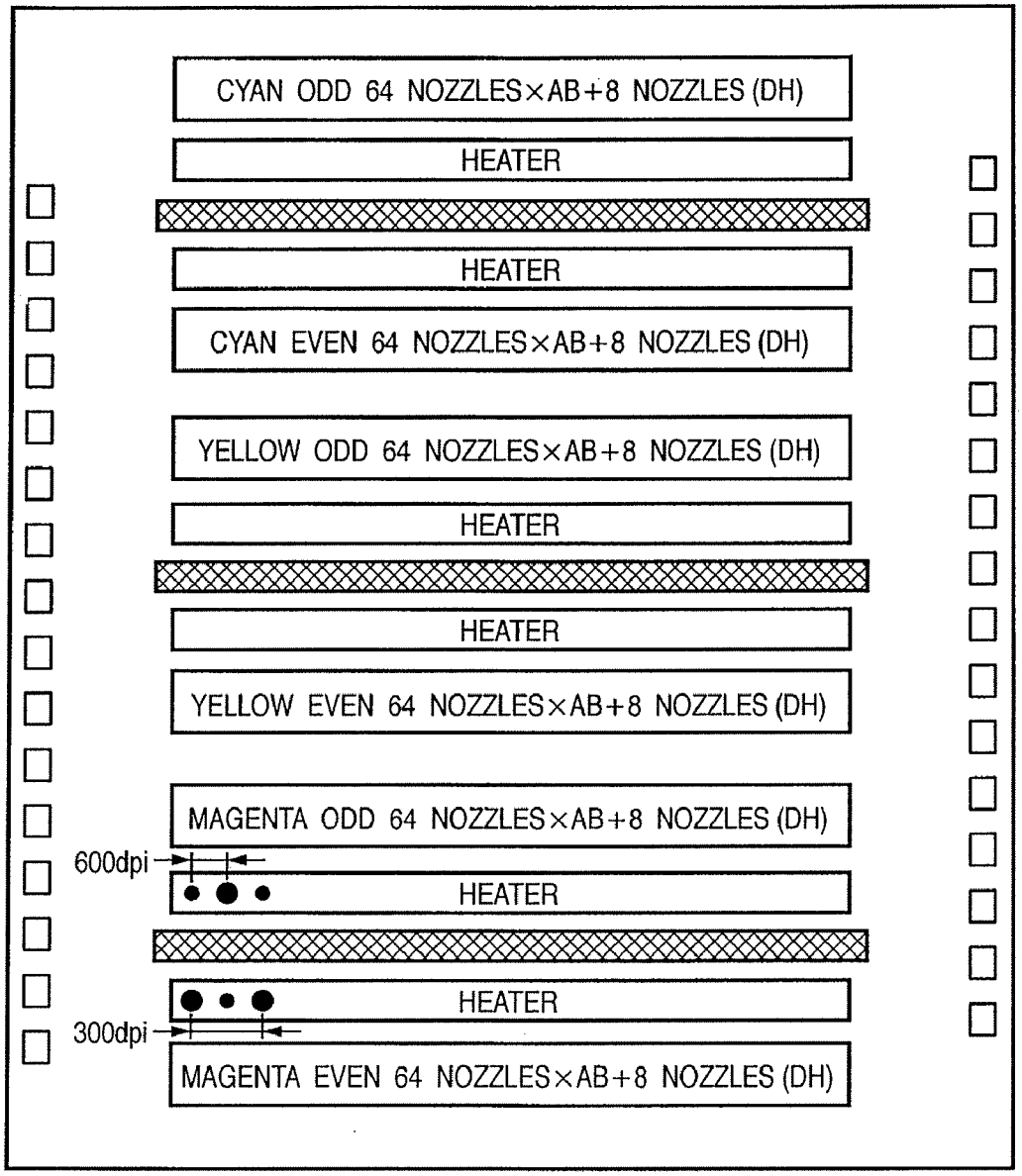
FIG. 15 is a view showing the chip layout of the printhead according to the embodiment of the present invention.

FIG. 15 is a view showing the chip layout of the printhead according to the embodiment of the present invention.

As shown in FIG. 15, the printhead of this embodiment has six nozzle arrays. Each nozzle array includes 64 main nozzles×2 (nozzles A and B) and eight dummy nozzles.

The nozzle A has a heater to discharge an ink droplet of 5 pl. The nozzle B has a heater to discharge an ink droplet of 2 pl. The heater corresponding to the nozzle A and the heater corresponding to the nozzle B will be referred to as heater A and heater B, respectively, hereinafter.

As shown in FIG. 15, the nozzles A and B are alternately arranged. The nozzle pitch between the nozzles A is 300 dpi. The nozzle pitch between the nozzles A and B is 600 dpi. The nozzles A and B are staggered. The nozzles A and B share the heat enable signal H_ENB 50 and therefore cannot be driven simultaneously.

Hence, the nozzles A or B are selected, or nozzles are switched by the Column TRG 52. This selection is done on the basis of the printing medium characteristic and image quality. For example, standard printing using a plain paper sheet is done at a high speed by reducing the number of times of print scanning by using the nozzles A. On the other hand, photo printing ensures a high image quality by multipath printing using a high-quality dedicated paper sheet and nozzles B.

The connection arrangement of driving signals and the nozzles of the printhead will be described next with reference to FIGS. 16 and 17.

FIG. 16 is a view showing a connection arrangement example of driving signals and the nozzles of the printhead according to the embodiment of the present invention. FIG. 17 is a view showing the structure of the nozzle surface of the printhead according to the embodiment of the present invention which is described in FIG. 15.

FIG. 16 shows the relationship between each of the EVEN and ODD nozzles per color and segments of driving signals.

The block selection data BLE is divided into 16 blocks 0 to 15. The heaters A and B are switched by the switching data BE4 (L/S) corresponding to bit14 in FIG. 14. No data is necessary to select a dummy nozzle. A dummy nozzle is selected by the dummy nozzle selection signal DHE corresponding to bit15 and a BLE number (block selection number) assigned to each dummy nozzle.

In the example shown in FIG. 16, the dummy nozzles (DH0A to DH7A and DH0B to DH7B) execute discharge when the BLE numbers 0, 1, 14, and 15 are selected. As a heat signal for discharge, H_ENB1 or H_ENB2 corresponding to a segment of connected dummy heaters is selected.

Figure 17:
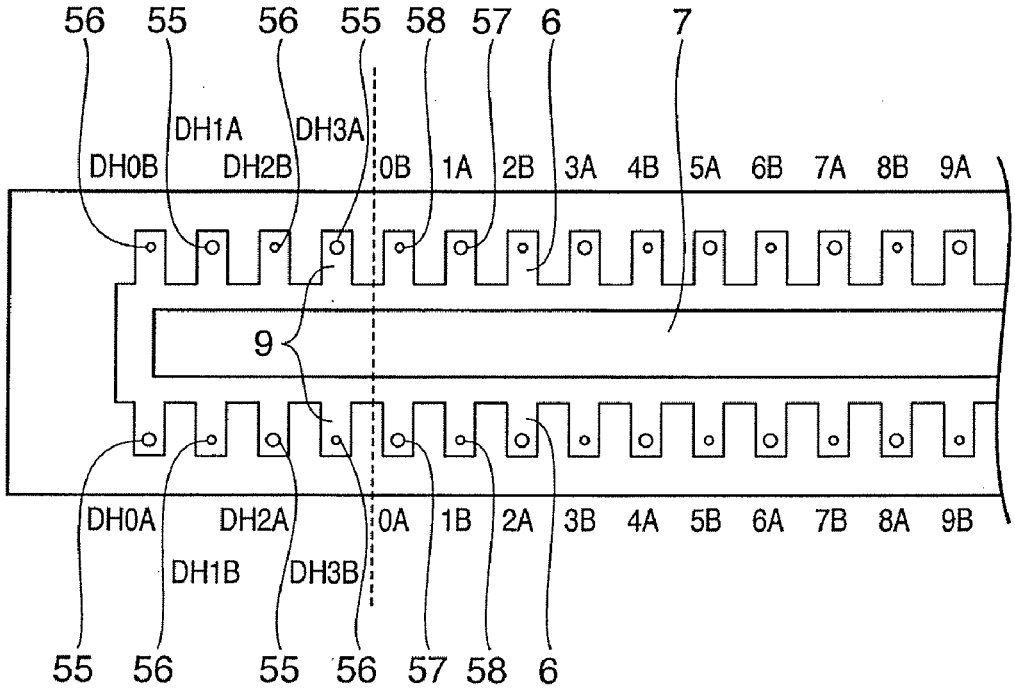
FIG. 17 is a view showing the structure of the nozzle surface of the printhead according to the embodiment of the present invention which is described in FIG. 15.

Referring to FIG. 17, a dummy nozzle (DH0A to DH3A) 55 has a heater A, and a dummy nozzle (DH0B to DH3B) 56 has a heater B. A main nozzle (0A to) 57 has a heater A, and a main nozzle (0B to) 58 has a heater B. Reference numerals 6, 7, and 9 denote main nozzle ink chamber, common ink chamber, and dummy nozzle dummy ink chamber, respectively.

In FIG. 17, the dummy nozzles 55 and 56 and the main nozzles 57 and 58 have the same pitch. The interval of the dummy nozzles 55 and 56 may be larger. The nozzle ports and heaters of the dummy nozzles 55 and 56 may be different from those of the main nozzles to control the discharge amount. The dummy nozzles have such a design as to obtain an optimum nozzle count, interval, and discharge amount.

The preliminary discharge sequence has various modes corresponding to application purposes. Examples of representative preliminary discharge modes will be described with reference to FIG. 18.

FIG. 18 is a view showing examples of preliminary discharge modes according to the present invention.

All nozzles including the dummy nozzles execute preliminary discharge of each mode. Hence, preliminary discharge is actually executed twice the number of shots of preliminary discharge shown in FIG. 18.

Preliminary discharge of the large nozzles (5 pl) and preliminary discharge of the small nozzles (2 pl) are executed sequentially. Hence, preliminary discharge is executed sequentially a total of four times in the order of the main nozzles of large nozzles (5 pl), the dummy nozzles of large nozzles (5 pl), the main nozzles of small nozzles (2 pl), and the dummy nozzles of small nozzles (2 pl).

For example, preliminary discharges G and J are executed after suction recovery. Preliminary discharge A is executed at the time of cap open. These preliminary discharges are executed to discharge ink mixed by recovery suction. Preliminary discharge N during printing is executed to keep the usable state of the nozzles by preventing ink in the nozzles from thickening.

A characteristic printhead driving method for preliminary discharge according to the present invention will be described next with reference to FIG. 1.

Figure 1:
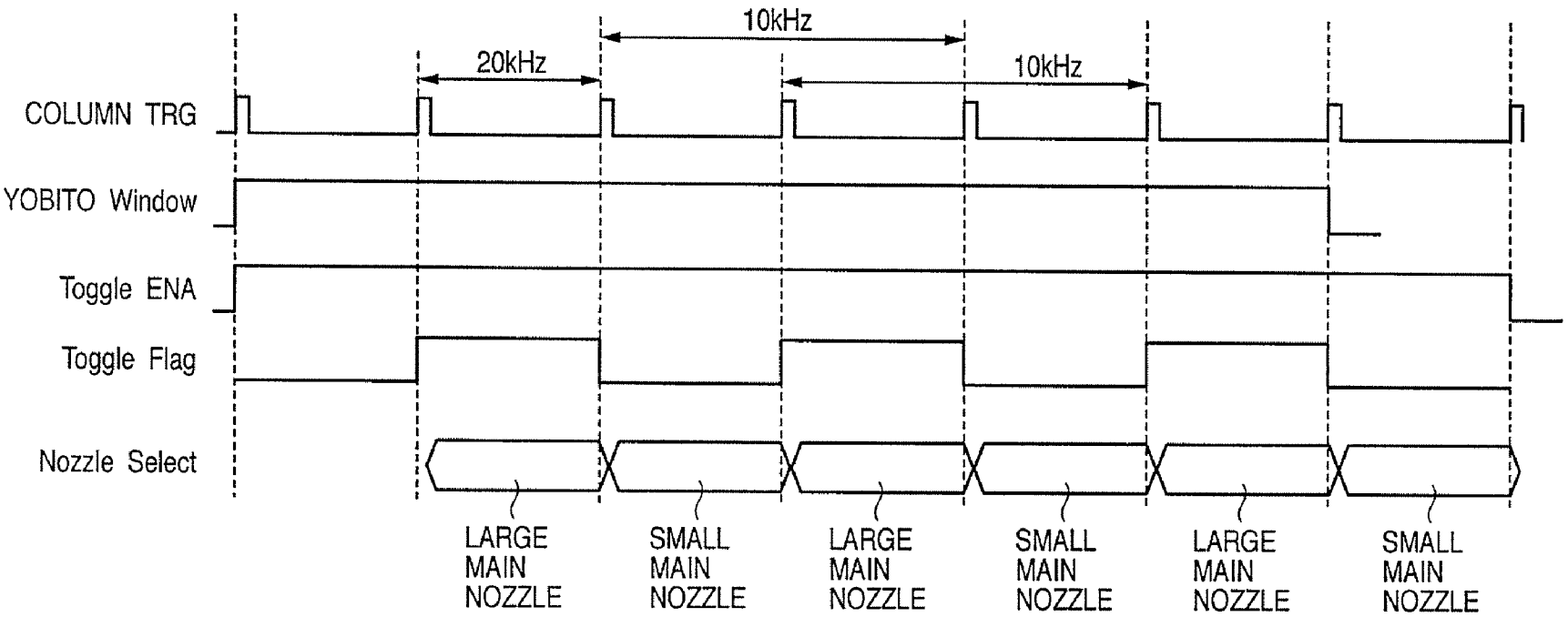
FIG. 1 is a timing chart of a characteristic printhead driving method according to an embodiment of the present invention.

FIG. 1 is a timing chart of the characteristic printhead driving method according to the embodiment of the present invention.

Referring to FIG. 1, a Toggle ENA signal is an enable signal representing whether to execute preliminary discharge of the main nozzles of large nozzles (to be referred to as large main nozzles hereinafter) (5 pl) and preliminary discharge of the main nozzles of small nozzles (to be referred to as small main nozzles hereinafter) (2 pl) in a toggle mode (alternately). A register (to be described later; FIG. 19A) sets the Toggle ENA signal. When the Toggle ENA signal is enabled ("High"), a Toggle Flag signal is repeatedly inverted for each Column TRG. Nozzle selection of the printhead 27 is done on the basis of the Toggle Flag signal.

When the Toggle Flag signal is "High" status, data to drive the large main nozzles is generated. When the Toggle Flag signal is "Low" status, data to drive the small main nozzles is generated. In the present invention, preliminary discharge to cause the large main nozzles and small main nozzles to alternately execute discharge will be referred to as large/small nozzle toggle preliminary discharge hereinafter. The printhead control block (HEAD_TOP) 34 executes this operation.

This printhead driving method can double the discharge frequency of preliminary discharge as compared to a conventional method.

In the example shown in FIG. 1, the interval of Column TRG can be 20 kHz. For this reason, even when the discharge frequency of preliminary discharge is twice, preliminary discharge of the large main nozzles and small main nozzles is executed for each column. The discharge frequency for each nozzle is ½, i.e., equal to the conventional discharge frequency. Hence, the total preliminary discharge time (total nozzle driving period) can be ½ as compared to the prior art.

A register to set ON/OFF of large/small nozzle toggle preliminary discharge will be described next with reference to FIG. 19A.

FIG. 19A is a view showing the register to set ON/OFF of large/small nozzle toggle preliminary discharge according to the embodiment of the present invention.

Figure 20:
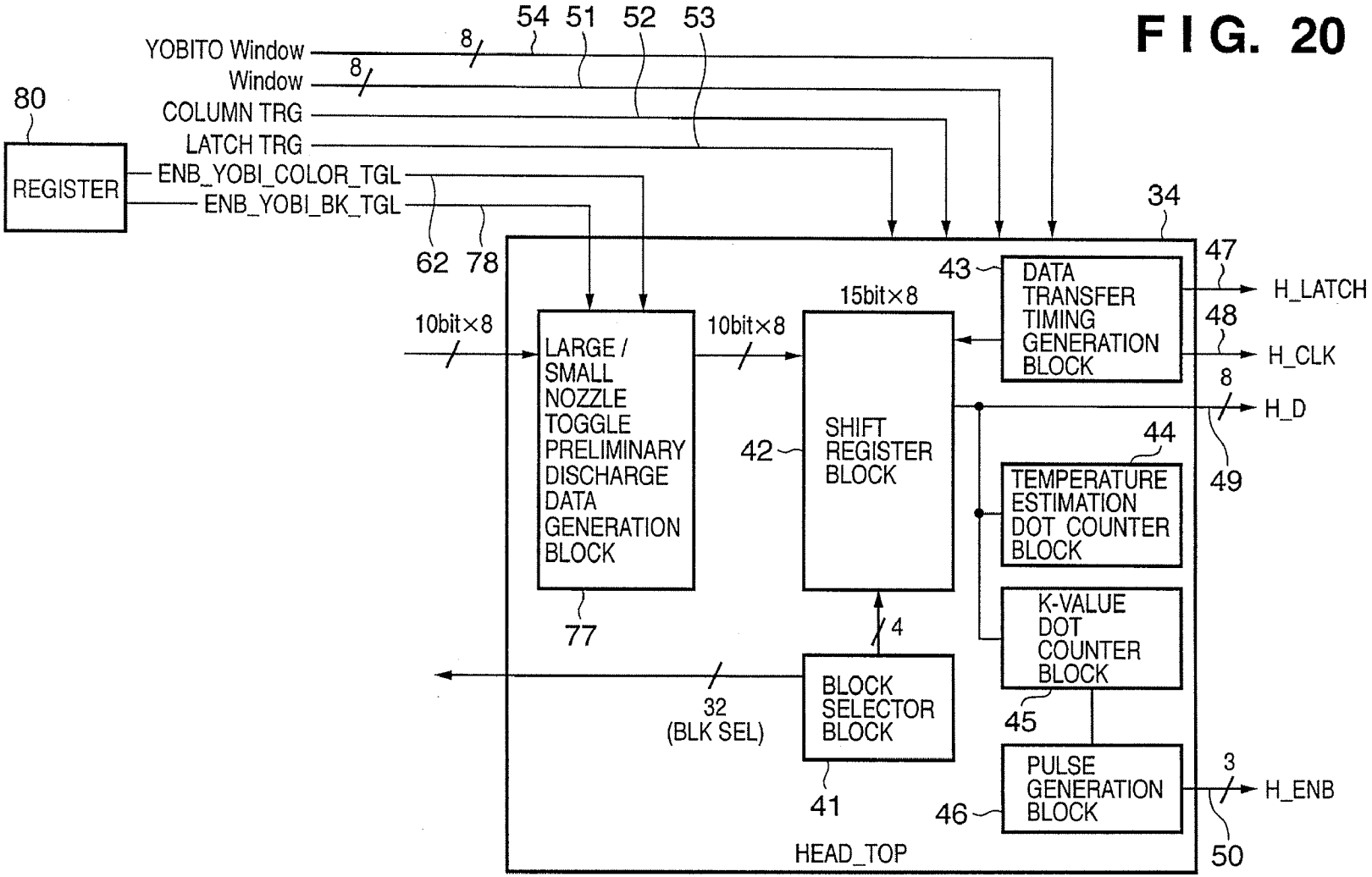
FIG. 20 is a block diagram showing a control block to implement large/small nozzle toggle preliminary discharge according to the embodiment of the present invention.

As shown in FIG. 19A, the register sets ON/OFF of large/small nozzle toggle preliminary discharge of black nozzles by bit0 and that of color nozzles by bit1. The value of the register corresponds to ENB_YOBI_COLOR_TGL 62 (FIG. 20). This signal corresponds to the Toggle ENA signal in FIG. 1.

The register to set ON/OFF of large/small nozzle toggle preliminary discharge supplies this signal that is enabled by "1" and disenabled by "0".

This register is formed as a register 80 shown in FIG. 20 on, e.g., the printhead control block (HEAD_TOP) 34. The register 80 can set the end nozzle of large/small nozzle toggle preliminary discharge to a large main nozzle or small main nozzle.

In executing toggle preliminary discharge of main nozzles and dummy nozzles, a register sets ON/OFF of toggle preliminary discharge of black nozzles by bit0 and that of color nozzles by bit1, as shown in FIG. 19B. The value of the register corresponds to ENB_YOBI_COLOR_TGL. The toggle preliminary discharge of the main nozzles and dummy nozzles will be referred to main/dummy nozzle toggle preliminary discharge hereinafter.

This register is formed as the register 80 shown in FIG. 20 on, e.g., the printhead control block (HEAD_TOP) 34. The register 80 can set the end nozzle of toggle preliminary discharge to a main nozzle or dummy nozzle.

A control block to implement large/small nozzle toggle preliminary discharge will be described next with reference to FIG. 20.

FIG. 20 is a block diagram showing the control block to implement large/small nozzle toggle preliminary discharge according to the embodiment of the present invention.

A large/small nozzle toggle preliminary discharge data generation block 77 to implement large/small nozzle toggle preliminary discharge is a characteristic functional block of the present invention and exists in the printhead control block (HEAD_TOP) 34.

An ENB_YOBI_BK_TGL 78 (black) signal and ENB_YOBI_COLOR_TGL 62 (color) signal for the register 80 connect to the large/small nozzle toggle preliminary discharge data generation block 77.

The YOBITO Window 54 and Column TRG 52 activate the large/small nozzle toggle preliminary discharge data generation block 77. The Column TRG 52 is valid only when the YOBITO Window 54 is open.

In accordance with the Column TRG 52, the large/small nozzle toggle preliminary discharge data generation block 77 generates a YOBI_COLOR_TGL_FLG signal (color) that is inverted for each column. Then, the large/small nozzle toggle preliminary discharge data generation block 77 generates nozzle data to execute large/small nozzle toggle preliminary discharge on the basis of, e.g., a circuit implemented by a circuit description language. If large/small nozzle toggle preliminary discharge is OFF, nozzle data passes through the block 77 without any processing and enters the shift register block 42.

In large/small nozzle toggle preliminary discharge, the number of shots of discharge of the large main nozzles is equal to that of the small main nozzles because of its driving principle, i.e., because the large main nozzles and small main nozzles alternately execute discharge at the same driving frequency. To the contrary, in conventional preliminary discharge (preliminary discharge by sequentially driving the main nozzles and dummy nozzles), preliminary discharge of main nozzles and that of dummy nozzles are executed at different timings. For this reason, it is possible to separately control the number of shots of preliminary discharge of the two kinds of nozzles in accordance with the application purpose and object.

If the printer 11 is left unused for a long time, or the printhead 27 is exchanged, it is preferable to control the ink consumption by separately controlling the number of shots of discharge of the large main nozzles and that of the small main nozzles. In this case, conventional preliminary discharge may be executed. The case wherein the printer 11 is left unused for a long time indicates a case wherein the clogging in the main nozzles of the printhead 27 may have occurred.

In this embodiment, for example, the CPU 22 monitors the state of the printhead 27 of the printer 11, and on the basis of the monitor result, setting of large/small nozzle toggle preliminary discharge is executed. For example, when the printhead 27 is left unused for a long time or exchanged, large/small nozzle toggle preliminary discharge is not set to execute conventional preliminary discharge. Once the conventional preliminary discharge is executed, large/small nozzle toggle preliminary discharge is set basically.

Even during this time, the CPU 22 can monitor the state of the printhead 27 of the printer 11 and cancel setting of large/small nozzle toggle preliminary discharge as needed to execute conventional preliminary discharge.

In executing main/dummy nozzle toggle preliminary discharge, the large/small nozzle toggle preliminary discharge data generation block 77 in FIG. 20 functions as a main/dummy nozzle toggle preliminary discharge data generation block. In this case, the main/dummy nozzle toggle preliminary discharge data generation block generates nozzle data to execute main/dummy nozzle toggle preliminary discharge.

The hardware of printhead control block (HEAD_TOP) 34 automatically switches the large main nozzles and small main nozzle in large/small nozzle toggle preliminary discharge (or the main nozzles and dummy nozzles in main/dummy nozzle toggle preliminary discharge). The hardware can also select the preliminary discharge start nozzle and end nozzle.

Switching in large/small nozzle toggle (or main/dummy nozzle toggle) preliminary discharge may be done by a preliminary discharge request command of software. This command also allows to select the preliminary discharge start nozzle and end nozzle.

A flowchart showing the large/small nozzle toggle preliminary discharge operation will be described next with reference to FIG. 21.

Figure 21:
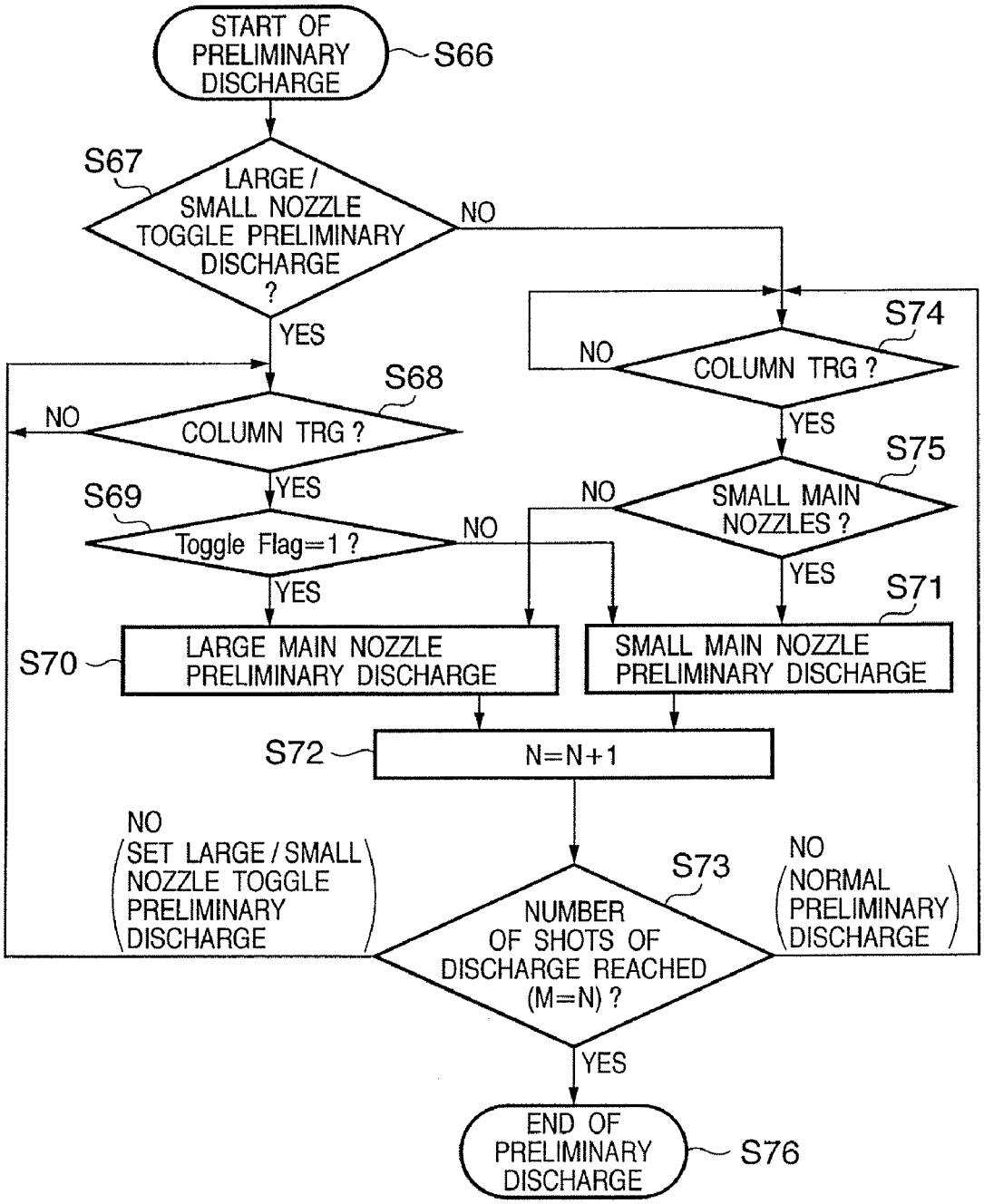
FIG. 21 is a flowchart showing the large/small nozzle toggle preliminary discharge operation according to the embodiment of the present invention.

FIG. 21 is a flowchart showing the large/small nozzle toggle preliminary discharge operation according to the embodiment of the present invention.

The large/small nozzle toggle preliminary discharge operation is executed under the control of the CPU 22.

In step S66, the preliminary discharge sequence starts. In step 567, ON/OFF of setting of large/small nozzle toggle preliminary discharge is determined. If large/small nozzle toggle preliminary discharge is set (YES in step S67), the process advances to step S68.

In step S68, the presence/absence of the Column TRG is determined. If the Column TRG is absent (NO in step S68), the process waits until it appears. If the Column TRG is present (YES in step S68), the process advances to step S69 to determine whether Toggle Flag=1.

If Toggle Flag=1 (YES in step S69), the process advances to step S70 to execute preliminary discharge of the large main nozzles. If Toggle Flag=0 (NO in step S69), the process advances to step S71 to execute preliminary discharge of the small main nozzles.

After execution of step S70 or S71, the number N of shots of preliminary discharge is counted in step S72. Every time discharge of one column is complete, the number N of shots of preliminary discharge is incremented by one.

In step S73, the current number N of shots of preliminary discharge is compared with the predetermined number M of shots of preliminary discharge. If number N of shots of preliminary discharge predetermined number M of shots of preliminary discharge, i.e., preliminary discharge of the predetermined number of shots is executed (YES in step S73), the process advances to step S76 to end the preliminary discharge sequence. If number N of shots of preliminary discharge≠predetermined number M of shots of preliminary discharge, and toggle preliminary discharge is executed, the process returns to step S68 to waits for the next Column TRG.

If large/small nozzle toggle preliminary discharge is not set in step S67 (NO in step S67), the process advances to step S74 to execute normal preliminary discharge in each preliminary discharge mode of the large main nozzles or small main nozzles.

In step S74, the presence/absence of the Column TRG is determined. If the Column TRG is absent (NO in step S74), the process waits until it appears. If the Column TRG is present (YES in step S74), the process advances to step S75 to determine whether the preliminary discharge target nozzles are the large main nozzles or small main nozzles.

If the preliminary discharge target nozzles are the large main nozzles (NO in step S75), the process advances to step S70 to execute preliminary discharge of the large main nozzles. If the preliminary discharge target nozzles are the small main nozzles (YES in step S75), the process advances to step S71 to execute preliminary discharge of the small main nozzles.

After execution of step S70 or S71, the number N of shots of preliminary discharge is counted in step S72. Every time discharge of one column is complete, the number N of shots of preliminary discharge is incremented by one.

In step S73, the current number N of shots of preliminary discharge is compared with the predetermined number M of shots of preliminary discharge. If number N of shots of preliminary discharge predetermined number M of shots of preliminary discharge, i.e., preliminary discharge of the predetermined number of shots is executed (YES in step S73), the process advances to step S76 to end the preliminary discharge sequence. If number N of shots of preliminary discharge≠predetermined number M of shots of preliminary discharge, and normal preliminary discharge is executed, the process returns to step S74 to waits for the next Column TRG If number N of shots of preliminary discharge≠predetermined number M of shots of preliminary discharge, and large/small nozzle toggle preliminary discharge is set, the process returns to step S68.

The above-described control flow may be executed not only by the CPU 22 but also by combining a logic circuit (hardware). More specifically, a preset register is provided to hold a flag (Toggle Flag). In step S69, whether to execute the processing in step S70 or S71 is determined on the basis of this flag. Another register with the same arrangement may be provided for step S75.

For step S72, a counter circuit to count the number of times of preliminary discharge is provided. In addition, a determination circuit to determine the end of preliminary discharge may be provided.

As described above, according to this embodiment, the preliminary discharge time can be shortened by executing large/small nozzle toggle preliminary discharge. More specifically, the preliminary discharge frequency can be twice that in the prior art so that whole preliminary discharge can be completed in a ½ time.

More specifically, it is possible to increase the discharge frequency of preliminary discharge to twice the conventional frequency by alternately executing discharge of the large main nozzles and that of small main nozzles for each column. That is, even when the discharge frequency of preliminary discharge is twice, preliminary discharge of the large main nozzles and small main nozzles is executed for each column, and the discharge frequency for each nozzle is ½, i.e., equal to the conventional discharge frequency. Hence, the total preliminary discharge time can be ½ as compared to the prior art.

Selective control of large/small nozzle toggle preliminary discharge and main/dummy nozzle toggle preliminary discharge will be described next.

As shown in FIG. 18, in various kinds of preliminary discharge control, the number of shots of preliminary discharge of the large main nozzles equals that of the small main nozzles in, e.g., the preliminary discharges A and G. On the other hand, the number of shots of preliminary discharge of the large main nozzles is different from that of the small main nozzles in, e.g., the preliminary discharges J and N.

As described above, to execute large/small nozzle toggle preliminary discharge, it is necessary to make the number of shots of preliminary discharge executed alternately equal between the large and small nozzles to manage the heat data generation conditions and the number of shots of preliminary discharge.

Figure 22:
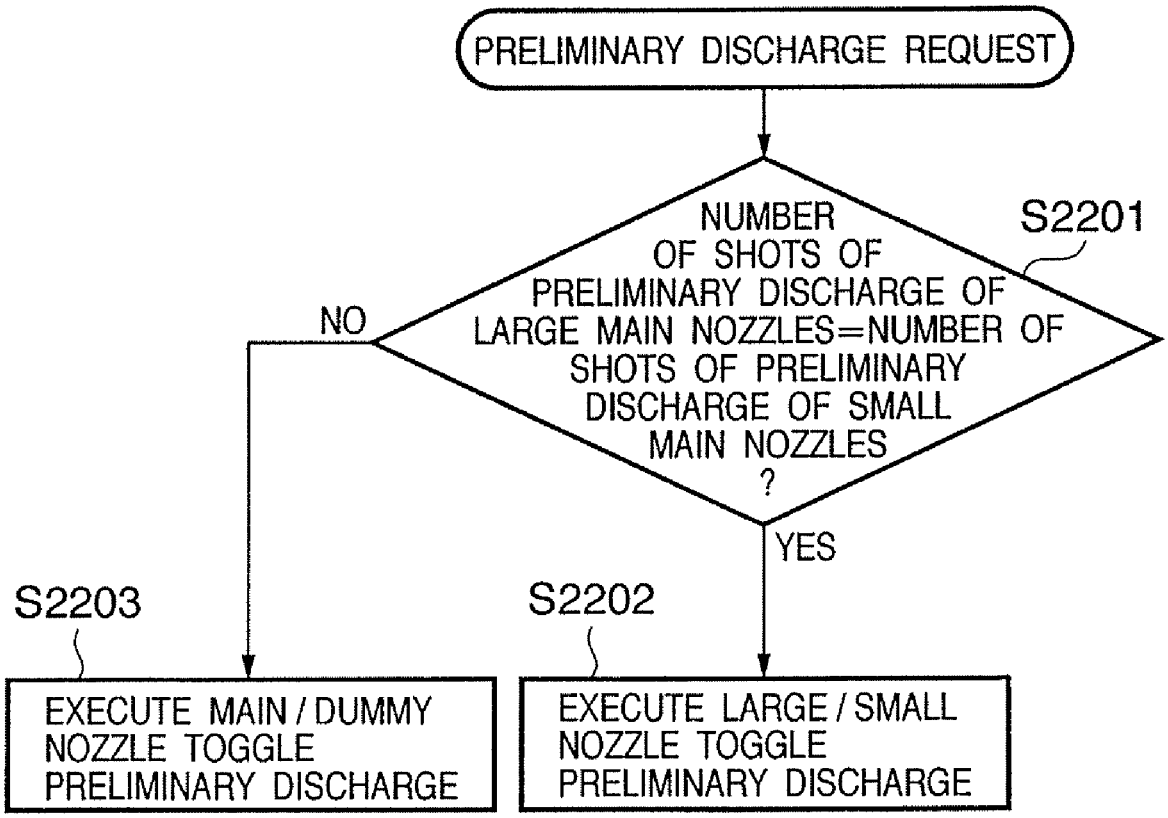
FIG. 22 is a flowchart showing switching between the large/small nozzle toggle preliminary discharge operation and the main/dummy nozzle toggle preliminary discharge operation according to the embodiment of the present invention.

As shown in FIG. 22, the CPU 22 shown in FIG. 10 determines in step s2201 whether the number of shots in a requested preliminary discharge mode equals between the large main nozzles and the small main nozzles. If the number of shots equals (YES in step S2201), large/small nozzle toggle preliminary discharge is executed in step S2202. That is, the processing shown in FIG. 21 is executed. If the number of shots is different (NO in step S2201), main/dummy nozzle toggle preliminary discharge is executed.

Figure 24A:
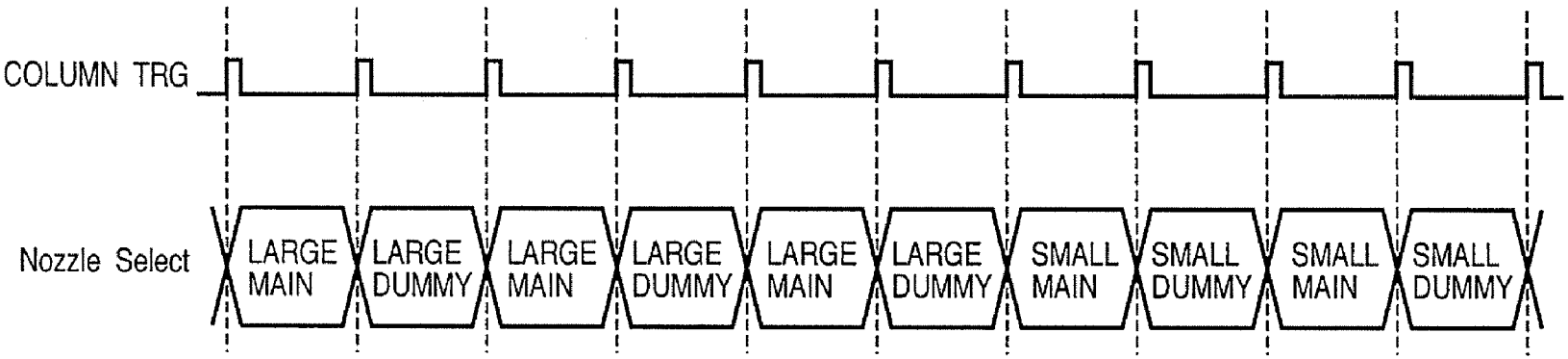
FIGS. 24A and 24B are timing charts of the large/small nozzle toggle preliminary discharge operation and main/dummy nozzle toggle preliminary discharge operation according to the embodiment of the present invention.
Figure 24B:
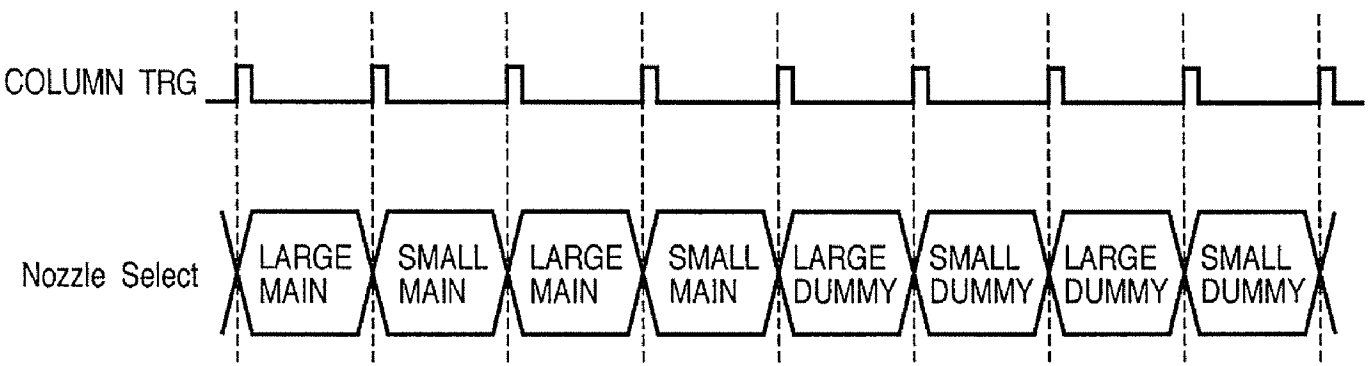

FIGS. 24A and 24B are timing charts for explaining the preliminary discharge timing. FIG. 24A is a timing chart for explaining the timing of main/dummy nozzle toggle preliminary discharge. In this example, three shots of preliminary discharge are executed for one large main nozzle, and two shots of preliminary discharge are executed for one small main nozzle. First, the large main nozzles execute preliminary discharge. Every time the Column TRG is input, the nozzles (main nozzles and dummy nozzles) to execute preliminary discharge are switched, as shown in FIG. 24A. After predetermined preliminary discharge is completed, the small main nozzles execute preliminary discharge.

FIG. 24B is a timing chart for explaining the timing of large/small nozzle toggle preliminary discharge. In this example, two shots of preliminary discharge are executed for one large main nozzle or one small main nozzle. First, the main nozzles execute preliminary discharge. Every time the Column TRG is input, the nozzles (large nozzles and small nozzles) to execute preliminary discharge are switched, as shown in FIG. 24B. After preliminary discharge is executed a predetermined number of times, the dummy nozzles execute preliminary discharge.

Since the number of shots of preliminary discharge is predetermined for each mode, the determination in step S2201 may be done on the basis of the preliminary discharge mode.

If the number of shots of preliminary discharge is more than or equal to for example, 1000, a sequence of the main/dummy nozzle toggle preliminary discharge as shown in FIG. 24A is executed at step S2203. If the number of shots of preliminary discharge is less than 1000, a sequence of the large/small nozzle toggle preliminary discharge as shown in FIG. 24B is executed at step S2202. As described the above, the number of shots of preliminary discharge is relatively large, the main/dummy nozzle toggle preliminary discharge is executed.

Figure 25:
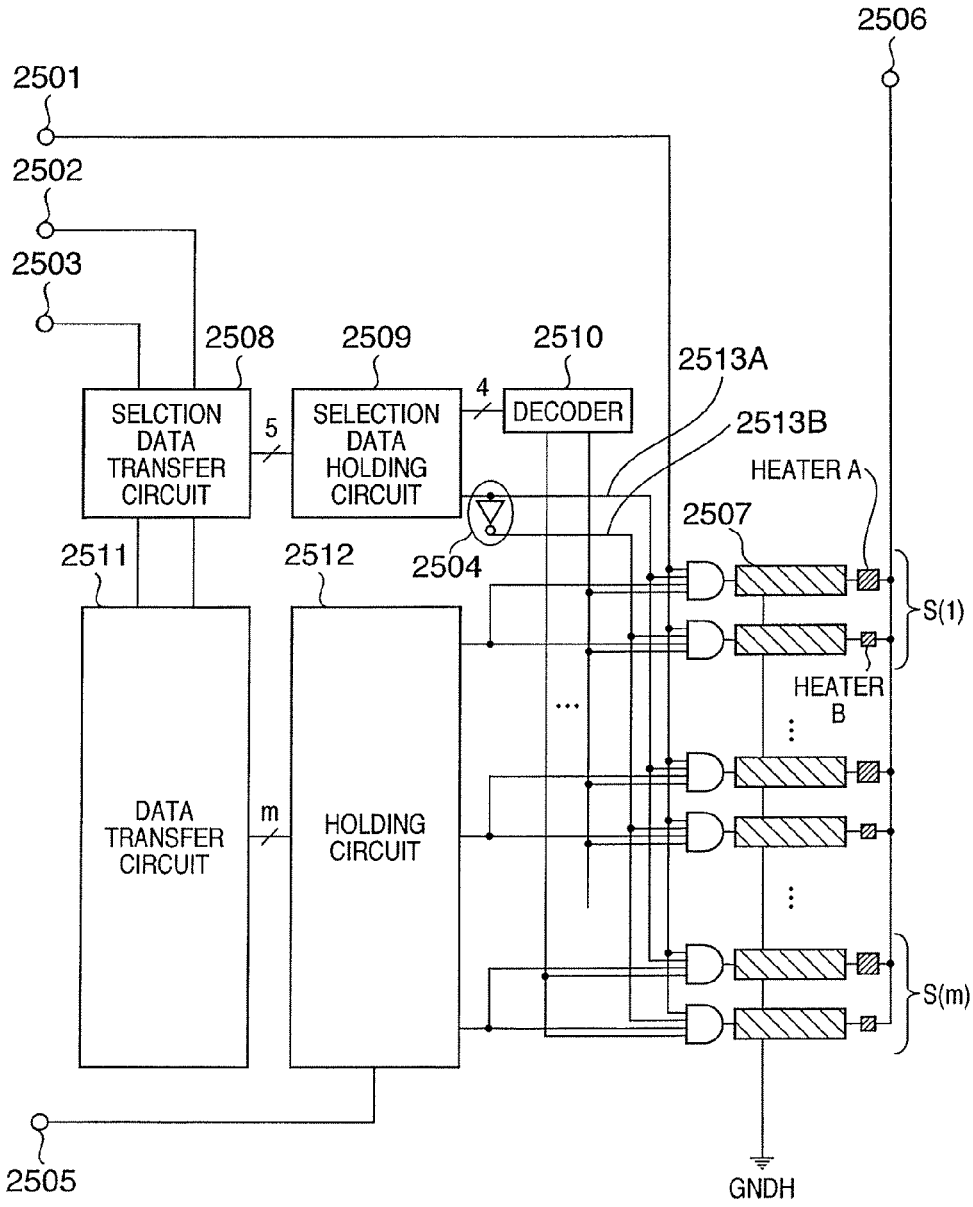
FIG. 25 is a view for explaining a printhead control block according to the embodiment of the present invention.

Supplemental explanation will be follows with reference to FIG. 25. For example, it is assumed that S(1), S(2), S(m-1) and S(m) are dummy nozzles and S(3)-S(m-2) are main nozzles.

In FIG. 24A, when first Column TRG is input, the heaters A of S(3)-S(m-2) are driven (the heater A is a heater for large nozzle). When next Column TRG is input, the heaters A of S(1), S(2), S(m-1) and S(m) are driven. As just described, the heater A for the main nozzle and the heater A for the dummy nozzle are alternately driven and each the heater A is driven three times. Further, for the small nozzle, the heaters B of S(1), S(2), S(m-1) and S(m) and the heaters B of S(3)-S(m-2) are alternately driven.

In FIG. 24B, when first Column TRG is input, the heaters A of S(3)-S(m-2) are driven. When next Column TRG is input, the heaters B of S(3)-S(m-2) are driven. As just described, the heater A for the main nozzle and the heater B for the main nozzle are alternately driven and each the heater A and the heater B is driven two times. Further, for the dummy nozzle, the heaters A and the heaters B are alternately driven.

Figure 23:
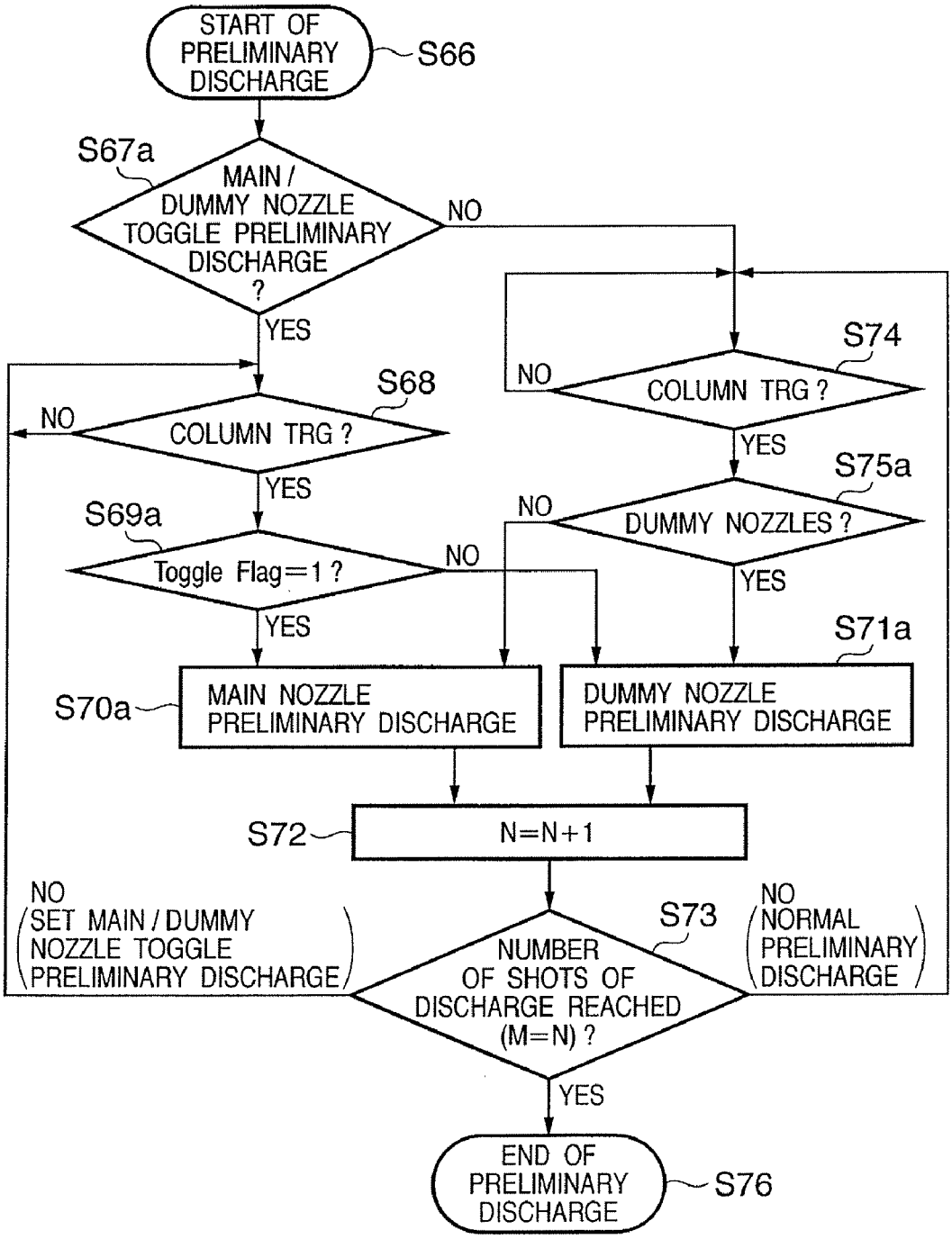
FIG. 23 is a flowchart showing the main/dummy nozzle toggle preliminary discharge operation according to the embodiment of the present invention.

For main/dummy nozzle toggle preliminary discharge, the processing shown in FIG. 21 is executed as the processing shown in FIG. 23.

The difference will be described. Instead of step S67 in FIG. 21, it is determined in step S67*a* in FIG. 23 whether main/dummy nozzle toggle preliminary discharge is set. Instead of step S70 in FIG. 21, in step S70*a* in FIG. 23, preliminary discharge of the main nozzles is executed. Instead of step S75 in FIG. 21, it is determined in step S75*a* in FIG. 23 whether the preliminary discharge target nozzles are the dummy nozzles. Instead of step S71 in FIG. 21, in step S71*a* in FIG. 23, preliminary discharge of the dummy nozzles is executed.

This allows to shorten the preliminary discharge time and adaptively select large/small nozzle toggle preliminary discharge and main/dummy nozzle toggle preliminary discharge so that optimum toggle preliminary discharge can be executed.

As described above, this embodiment can increase the discharge frequency of preliminary discharge to twice the conventional frequency by alternately executing discharge of the large main nozzles and that of small main nozzles for each column. That is, even when the discharge frequency of preliminary discharge is twice, preliminary discharge of the large main nozzles and small main nozzles is executed for each column, and the discharge frequency for each nozzle is ½, i.e., equal to the conventional discharge frequency.

Hence, the total preliminary discharge time can be ½ as compared to the prior art. It is also possible to select an optimum mode from large/small nozzle toggle preliminary discharge and main/dummy nozzle toggle preliminary discharge.

The above-described arrangement of the present invention can cause the nozzles of the printhead to smoothly and reliably discharge ink staying at the stagnation portions of the common ink chamber of the printhead. The arrangement can also increase the discharge frequency of preliminary discharge to twice the conventional frequency so that whole preliminary discharge can be complete in a ½ time.

In the above-described embodiment, a nozzle with a relatively large ink amount is defined as a large nozzle, and a nozzle with a relatively small ink amount is defined as a small nozzle on the basis of the nozzle diameter. However, the present invention is not limited to this example. The size of the heater may be changed, although the nozzle diameter does not change. In the above description, the droplet discharged from the printhead is ink, and the liquid stored in the ink tank is ink. However, the liquid stored in the ink tank is not limited to ink. For example, the ink tank may store a process solution that is discharged to a printing medium to increase the fixing properties and water resistance of a printed image or its image quality.

The above-described embodiment of an inkjet printing scheme especially comprises a means (e.g., an electrothermal transducer or laser beam) for generating heat energy as energy utilized to discharge ink. The ink state is changed by the heat energy to increase the print density and resolution.

A full line type printhead having a length corresponding to the maximum width of a printing medium printable by the printing apparatus may ensure the length by combining a plurality of printheads or by using a single integrated printhead structure.

The present invention is not limited to the cartridge type printhead described in the above embodiment, which includes an ink tank integrated with the printhead itself. Instead, an interchangeable chip type printhead which can be electrically connected to the apparatus main body and receive ink from it when attached to the apparatus main body may be used.

It is preferable to add a printhead recovery means or preliminary means to the above-described printing apparatus to attain a more stable printing operation. Practical examples are a printhead capping means, a cleaning means, a pressurizing or suction means, an electrothermal transducer, another heating element, and a preliminary heating means formed by combining them. A preliminary discharge mode to perform discharge unrelated to printing is also effective for stable printing.

The printing apparatus can have not only a print mode using a main color such as black but also a mode using an integrated printhead or a combination of a plurality of printheads. The apparatus may have at least one of a multicolor printhead with different colors and a full-color printhead by color mixing.

The printing apparatus according to the present invention may be provided integrally or separately as an image output terminal of an information processing device such as a computer. Also, the printing apparatus can take any form of a copying apparatus combined with a reader and a facsimile apparatus having a transmitting/receiving function.

Note that the present invention can be applied to an apparatus comprising a single device or to system constituted by a plurality of devices.

Furthermore, the invention can be implemented by supplying a software program, which implements the functions of the foregoing embodiments, directly or indirectly to a system or apparatus, reading the supplied program code with a computer of the system or apparatus, and then executing the program code. In this case, so long as the system or apparatus has the functions of the program, the mode of implementation need not rely upon a program.

Accordingly, since the functions of the present invention are implemented by computer, the program code installed in the computer also implements the present invention. In other words, the claims of the present invention also cover a computer program for the purpose of implementing the functions of the present invention.

In this case, so long as the system or apparatus has the functions of the program, the program may be executed in any form, such as an object code, a program executed by an interpreter, or scrip data supplied to an operating system.

Example of storage media that can be used for supplying the program are a floppy disk, a hard disk, an optical disk, a magneto-optical disk, a CD-ROM, a CD-R, a CD-RW, a magnetic tape, a non-volatile type memory card, a ROM, and a DVD (DVD-ROM and a DVD-R).

As for the method of supplying the program, a client computer can be connected to a website on the Internet using a browser of the client computer, and the computer program of the present invention or an automatically-installable compressed file of the program can be downloaded to a recording medium such as a hard disk. Further, the program of the present invention can be supplied by dividing the program code constituting the program into a plurality of files and downloading the files from different websites. In other words, a WWW (World Wide Web) server that downloads, to multiple users, the program files that implement the functions of the present invention by computer is also covered by the claims of the present invention.

It is also possible to encrypt and store the program of the present invention on a storage medium such as a CD-ROM, distribute the storage medium to users, allow users who meet certain requirements to download decryption key information from a website via the Internet, and allow these users to decrypt the encrypted program by using the key information, whereby the program is installed in the user computer.

Besides the cases where the aforementioned functions according to the embodiments are implemented by executing the read program by computer, an operating system or the like running on the computer may perform all or a part of the actual processing so that the functions of the foregoing embodiments can be implemented by this processing.

Furthermore, after the program read from the storage medium is written to a function expansion board inserted into the computer or to a memory provided in a function expansion unit connected to the computer, a CPU or the like mounted on the function expansion board or function expansion unit performs all or a part of the actual processing so that the functions of the foregoing embodiments can be implemented by this processing.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-360839 filed on Dec. 14, 2005, which is hereby incorporated by reference herein in its entirety.

What is claimed is:

1. A printing apparatus for printing by using a printhead which has a first nozzle array and a second nozzle array, each having a plurality of first nozzles from which a first amount of the ink is discharged and a plurality of second nozzles from which a second amount of the ink is discharged and including main nozzles to be used for printing on a printing medium and dummy nozzles not to be used for printing on the printing medium, comprising:

driving means for driving the nozzles of the first nozzle array and the second nozzle array;

referring means for referring, within a predetermined period, a first flag signal indicating selection of the main nozzles or the dummy nozzles in the first nozzle array and the second nozzle array, and a second flag signal indicating selection of the first nozzles or the second nozzles in the first nozzle array and the second nozzle array;

determination means for determining a number of shots of preliminary discharge in a preliminary discharge mode executed in response to a preliminary discharge request; and control means for executing, on the basis of the number of shots of preliminary discharge determined by said determination means, first preliminary discharge control to drive said driving means while alternately selecting the main nozzles and the dummy nozzles on the basis of a value of the first flag signal referred by said referring means, and second preliminary discharge control to drive said driving means while alternately selecting the first nozzles and the second nozzles on the basis of a value of the second flag signal referred by referring means, wherein said control means, by switching a value of the first flag signal in the first preliminary discharge and switching a value of the second flag signal in the second preliminary discharge every lapse of the predetermined period, further executes in the first preliminary discharge, sequential drive of the first nozzles and the second nozzles in the first nozzle array and the second nozzle array; and in the second preliminary discharge, sequential drive of the main nozzles and the dummy nozzles in the first nozzle array and the second nozzle array.

2. The apparatus according to claim 1, wherein a frequency of a sync signal in the first preliminary discharge control and the second preliminary discharge control is twice a frequency of a sync signal in individual preliminary discharge control for the first nozzle array and the second nozzle array.

3. The apparatus according to claim 1, wherein the first preliminary discharge control is executed when the number of shots of preliminary discharge of the nozzles of the first nozzle away is different from the number of shots of preliminary discharge of the nozzles of the second nozzle array.

4. The apparatus according to claim 1, wherein a diameter of each of the second nozzles is smaller than a diameter of each of the first nozzles.

5. The apparatus according to claim 1, where a plurality of nozzles of the first nozzle arrays and the second nozzle arrays in the printhead are divided into a plurality of blocks, and said control means selects nozzles to be driven by said driving means per block, from the first nozzle away and the second nozzle array within the predetermined period.

6. The apparatus according to claim 5, further comprising information generation means for generating preliminary discharge data including information for selecting each block corresponding to the first nozzle array and the second nozzle array, information for selecting the first nozzles or the second nozzles, and information for selecting the main nozzles or the dummy nozzles.

7. The apparatus according to claim 1, wherein the second amount of ink is less than the first amount of ink.

8. A method of controlling a printing apparatus for printing by using a printhead which has a first nozzle array and a second nozzle array, each having a plurality of first nozzles from which a first amount of the ink is discharged and a plurality of second nozzles from which a second amount of the ink is discharged and including main nozzles to be used for printing on a printing medium and dummy nozzles not to be used for printing on the printing medium, comprising the steps of:

a driving step of driving the nozzles of the first nozzle array and the second nozzle array;

a referring step of referring, within a predetermined period, a first flag signal indicating selection of the main nozzles or the dummy nozzles in the first nozzle array and the second nozzle array, and a second flag signal indicating selection of the first nozzles or the second nozzles in the first nozzle array and the second nozzle array;

a determination step of determining a number of shots of preliminary discharge in a preliminary discharge mode executed in response to a preliminary discharge request; and a first preliminary discharge control step of executing, on the basis of the number of shots of preliminary discharge determined in the determination step, the driving step while alternately selecting the main nozzles and the dummy nozzles on the basis of a value of the first flag signal referred by the referring step; and a second preliminary discharge control step of executing the driving step while alternately selecting the first nozzles and the second nozzles on the basis of a value of the second flag signal referred by the referring step, wherein, by switching a value of the first flag signal in the first preliminary discharge step and switching a value of the second flag signal in the second preliminary discharge step every lapse of the predetermined period, further executing in the first preliminary discharge step, sequential drive of the first nozzles and the second nozzles in the first nozzle array and the second nozzle array; and in the second preliminary discharge step, sequential drive of the main nozzles and the dummy nozzles in the first nozzle array and the second nozzle array.

* * * * *